US009858862B2

(12) United States Patent
Kwon et al.

(10) Patent No.: US 9,858,862 B2
(45) Date of Patent: Jan. 2, 2018

(54) DISPLAY DEVICE AND METHOD FOR DRIVING THE DISPLAY DEVICE

(71) Applicant: LG DISPLAY CO., LTD., Seoul (KR)

(72) Inventors: OhJong Kwon, Anyang-si (KR); SungWoo Park, Gimhae-si (KR)

(73) Assignee: LG DISPLAY CO., LTD., Seoul (KR)

( * ) Notice: Subject to any disclaimer, the term of this patent is extended or adjusted under 35 U.S.C. 154(b) by 18 days.

(21) Appl. No.: 14/924,348

(22) Filed: Oct. 27, 2015

(65) Prior Publication Data

US 2016/0189615 A1 Jun. 30, 2016

(30) Foreign Application Priority Data

Dec. 24, 2014 (KR) ..... 10-2014-0188194

(51) Int. Cl.

| | |
|---|---|
| ***G09G 3/30*** | (2006.01) |
| ***G09G 3/3258*** | (2016.01) |
| ***G09G 3/3233*** | (2016.01) |
| *G09G 3/3291* | (2016.01) |

(52) U.S. Cl.

CPC ..... *G09G 3/3258* (2013.01); *G09G 3/3233* (2013.01); *G09G 3/3291* (2013.01); *G09G 2310/027* (2013.01); *G09G 2310/0291* (2013.01); *G09G 2310/08* (2013.01); *G09G 2320/0233* (2013.01); *G09G 2320/0285* (2013.01); *G09G 2320/0295* (2013.01); *G09G 2320/043* (2013.01); *G09G 2330/12* (2013.01)

(58) Field of Classification Search

CPC ..... G09G 3/3258; G09G 3/3233; G09G 2310/027; G09G 2310/0291; G09G 2310/08; G09G 2320/0233; G09G 2320/0295; G09G 3/3291; G09G 2320/043; G09G 2320/0285; G09G 2330/12

See application file for complete search history.

(56) References Cited

U.S. PATENT DOCUMENTS

| | | | | |
|---|---|---|---|---|
| 9,202,411 | B2 * | 12/2015 | Jung | G09G 3/3208 |
| 2007/0210996 | A1 * | 9/2007 | Mizukoshi | G09G 3/3233 345/77 |
| 2008/0100609 | A1 * | 5/2008 | Lee | G09G 3/3233 345/212 |
| 2010/0053129 | A1 | 3/2010 | Morita | |

(Continued)

FOREIGN PATENT DOCUMENTS

| | | | |
|---|---|---|---|
| CN | 1450510 | A | 10/2003 |
| CN | 101556757 | A | 10/2009 |

(Continued)

*Primary Examiner* — Kwang-Su Yang

(74) *Attorney, Agent, or Firm* — Birch, Stewart, Kolasch & Birch, LLP

(57) ABSTRACT

A display device and a method of driving the display device are discussed. The display device includes a display panel which has subpixels disposed at points where data lines intersect gate lines. A data driver supplies a data voltage corresponding to specific input data to the data lines. An analog-to-digital converter (ADC) senses the data voltage supplied to at least one data line of the data lines, and converts the sensed data voltage to digital sensed data. A timing controller supplies compensation data compensated based on the digital sensed data to the data driver, thereby compensating for a deviation of the data driver.

16 Claims, 19 Drawing Sheets

(56) References Cited

U.S. PATENT DOCUMENTS

| | | | | |
|---|---|---|---|---|
| 2012/0044235 | A1 | 2/2012 | Cha et al. | |
| 2013/0162617 | A1* | 6/2013 | Yoon | G09G 3/3291 345/211 |
| 2013/0169699 | A1 | 7/2013 | Jeong et al. | |
| 2015/0097870 | A1* | 4/2015 | Lee | G09G 3/2096 345/690 |
| 2015/0213757 | A1* | 7/2015 | Takahama | G09G 3/3291 345/691 |
| 2015/0302793 | A1* | 10/2015 | In | G09G 3/3208 345/211 |

FOREIGN PATENT DOCUMENTS

| | | | |
|---|---|---|---|
| CN | 103177685 | A | 6/2013 |
| CN | 103207365 | A | 7/2013 |
| CN | 103903582 | A | 7/2014 |

* cited by examiner

DISPLAY DEVICE AND METHOD FOR DRIVING THE DISPLAY DEVICE

CROSS REFERENCE TO RELATED APPLICATION

This application claims priority from and the benefit under 35 U.S.C. §119(a) of Korean Patent Application Number 10-2014-0188194 filed on Dec. 24, 2014, which is herein incorporated by reference.

BACKGROUND OF THE INVENTION

Field of the Invention

The present invention relates to a display device that displays images.

Description of Related Art

In response to the growth of the information society, there is increasing demand for various types of display device able to display images. Various display devices, such as liquid crystal displays (LCDs), plasma display panels (PDPs), and organic light-emitting diode (OLED) display devices, are currently used.

Such a display device includes a display panel on which data lines and gate lines intersect each other and subpixels are defined at the intersection points of the data lines and the gate lines. The display device further includes a data driver for supplying data signals to the data lines and a gate driver for supplying gate signals to the gate lines.

A transistor is disposed in each of the subpixels defined on the display panel. The characteristics of the transistor within each subpixel may change according to the operation time or may differ from those of the transistor within the other subpixel. In addition, when the display device is an OLED display device, OLEDs in the subpixels may deteriorate at different rates. This phenomenon may cause non-uniform luminance in the subpixels, thereby degrading image quality.

Therefore, in order to address the issue of non-uniform luminance of the subpixels, pixel compensation technology for compensating for a change or difference in the characteristics of devices (e.g., a transistor or an OLED) within circuits has been proposed.

This pixel compensation technology is a technology intended to prevent or reduce the incidence of non-uniformity in terms of the luminance between subpixels.

However, although this pixel compensation function is provided, a phenomenon in which the luminance of each subpixel or the difference in the levels of luminance between the subpixels is not compensated may remain.

In addition, the data driver may have an output error, or when the data driver includes two or more data driver integrated circuits (DICs), the DICs may have a difference in outputs.

BRIEF SUMMARY OF THE INVENTION

Various aspects of the present invention are intended to overcome a problem in that the luminance of each subpixel or the difference in the levels of luminance between subpixels is not compensated although the pixel compensation function is provided.

The present invention is also intended to address the issue of an output error of a data driver, or when the data driver includes two or more data driver integrated circuits (DICs), output differences of the DICs.

In an aspect of the present invention, provided is a display device including: a display panel having subpixels disposed at points where data lines intersect gate lines; a data driver supplying a data voltage corresponding to specific input data to the data lines; an analog-to-digital converter (ADC) sensing the data voltage supplied to at least one data line of the data lines, and converting the sensed data voltage to digital sensed data; and a timing controller supplying compensation data compensated based on the digital sensed data to the data driver, thereby compensating for a deviation of the data driver.

In another aspect of the present invention, provided is a data driver including: two or more digital-to-analog converters (DACs) electrically connected to data lines to supply a data voltage to the data lines; and an ADC transmitting sensed data obtained by sensing the data voltage supplied to one data line of the data lines connected to one digital-to-analog converter of the two or more digital-to-analog converters.

According to the present invention as set forth above, it is possible to overcome the problem in that the luminance of each subpixel or the difference in the levels of luminance between the subpixels is not compensated although the pixel compensation function is provided.

According to one aspect of the present invention, a display device includes a display panel on which subpixels are disposed; a data driver adapted to supply a data voltage corresponding to a test pattern data to at least one data line; at least one analog-to-digital converter sensing at least one data voltage supplied to at least one data line, and converting the sensed data voltages to digital sensed data; and a controller adapted to supply compensation data generated based on the digital sensed data to the data driver connected to at least one data line of the data lines, the controller includes a data driver deviation compensation unit compensating for a deviation of the data driver based on the on the digital sensed data.

The data driver may include at least two data driving ICs adapted to supply a data voltage corresponding to the test pattern data to at least one data line connected to the at least two data driving ICs, wherein the least one analog-to-digital converter is adapted to sense at least one data voltage of each of the at least two data driving ICs, and converting the sensed data voltages to digital sensed data.

The same test pattern data may be supplied to data lines connected to the at least two data driving ICs.

The test pattern data may supplied to one data line of the first data driving ICs and to one data line of the second data driving ICs, wherein the two data lines are adjacent to each other and the first and second data driving ICs are adjacent to each other, wherein the least one analog-to-digital converter is adapted to sense the data voltages supplied to the adjacent data lines of the two adjacent data driving ICs.

The analog-to-digital converter may be included in one of the at least two data driving ICs or in the controller or each data driver IC includes one analog-to-digital converter.

Each data driving IC may include a plurality of digital-analog converters, corresponding to the number of data lines connected to the respective data driving IC.

At least one output terminal of each of the two or more data driver ICs may be connected to the analog-to-digital converter of the data driver ICs.

The analog-to-digital converter may be adapted to sense the data voltage supplied to at least one data line of the data lines connected to one digital-to-analog converter of the two or more digital-to-analog converters and/or is adapted to convert the sensed voltages into sensed data.

At least one outermost output of each of the data driver ICs may be connected to the one analog-to-digital converter or the two outermost outputs of a data driver ICs are connected to the analog-to-digital converter included in the data driver IC, respectively.

Preferably, the display device may further comprise a memory. The controller may is adapted to store at least one of the sensed data, and a difference value indicating a difference between a reference value based on the test pattern data and the sensed data in the The controller may be adapted to store output errors according to the data driver ICs in the memory, the output errors being differences between the reference data based on the test pattern data and the sensed data, and to supply compensation data produced by compensating for the sensed data with the output errors stored according to the data driver ICs to each of the data driver ICs.

The controller may be adapted to store output errors for the data driver ICs in the memory, the output errors being differences between the sensed data of the data driver ICs and an average of the sensed data, and to supply compensation data produced by compensating for the sensed data with the output errors stored according to the data driver ICs to the data driver integrated circuits.

The display panel may comprise one sensing line for one or more subpixels, the sensing line being connected to the one or more subpixels, the one or more analog-to-digital converters convert sensed voltages measured through one or more sensing channels corresponding to the sensing lines to the digital sensed data.

The controller may be adapted to acquire average sensed data according to the data driver ICs by averaging a plurality of sensed data obtained from the one or more analog-to-digital converters, each of which is included in a corresponding data driver IC of the two or more data driver ICs, to perform an analog-to-digital converter compensation by updating a lookup table based on differences between the average sensed data according to the data driver ICs for a same voltage and reference data according to the data driver ICs.

The controller may be adapted to subsequently compensate for a threshold voltage of a transistor within each of the subpixels by referring to the updated lookup table after the analog-to-digital converter compensation.

The controller may be adapted to compensate for a deviation in the data driver after the analog-to-digital converter compensation and/or during normal driving.

The test data pattern may correspond to a monochrome pattern.

According to another aspect of the invention, a method for driving a display device includes a display panel having a plurality of subpixels and a data driver including an analog-to-digital converter and a controller, comprising the steps of: supplying a data voltage corresponding to test pattern data to data lines; sensing a data voltage supplied to at least one data line of the data lines, and converting the sensed data voltage to digital sensed data; and supplying compensation data compensated based on the digital sensed data to at least one data line of the data lines.

Preferably, the monochrome pattern comprises a gray pattern.

The analog-to-digital converter may be included in the data driver.

Further a data driver can include two or more digital-to-analog converters electrically connected to data lines to supply a data voltage to the data lines. The data driver further includes an analog-to-digital converter transmitting sensed data obtained by sensing the data voltage supplied to one data line of the data lines connected to one digital-to-analog converter of the two or more digital-to-analog converters.

An output terminal of one digital-to-analog converter of the two or more digital-to-analog converters may be connected to an input terminal of the analog-to-digital converter.

The data driver may comprise two or more data driver integrated circuits each including the two or more digital-to-analog converters and the analog-to-digital converter, wherein, in each of the data driver integrated circuits, an output terminal of one digital-to-analog converter of the two or more digital-to-analog converters is connected to an input terminal of the analog-to-digital converter.

In one of the data driver integrated circuits, the digital-to-analog converter, the output terminal of which is connected to the input terminal of the analog-to-digital converter, may be adjacent to another data driver integrated circuit, and when other data driver integrated circuits are adjacent to both ends of one data driver integrated circuit, the output terminals of the two digital-to-analog converters adjacent to the other data driver integrated circuits are connected to the input terminal of the analog-to-digital converter.

In addition, according to the present invention, it is possible to compensate for an output error of the data driver, or when the data driver includes two or more DICs, compensate for output differences of the DICs.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
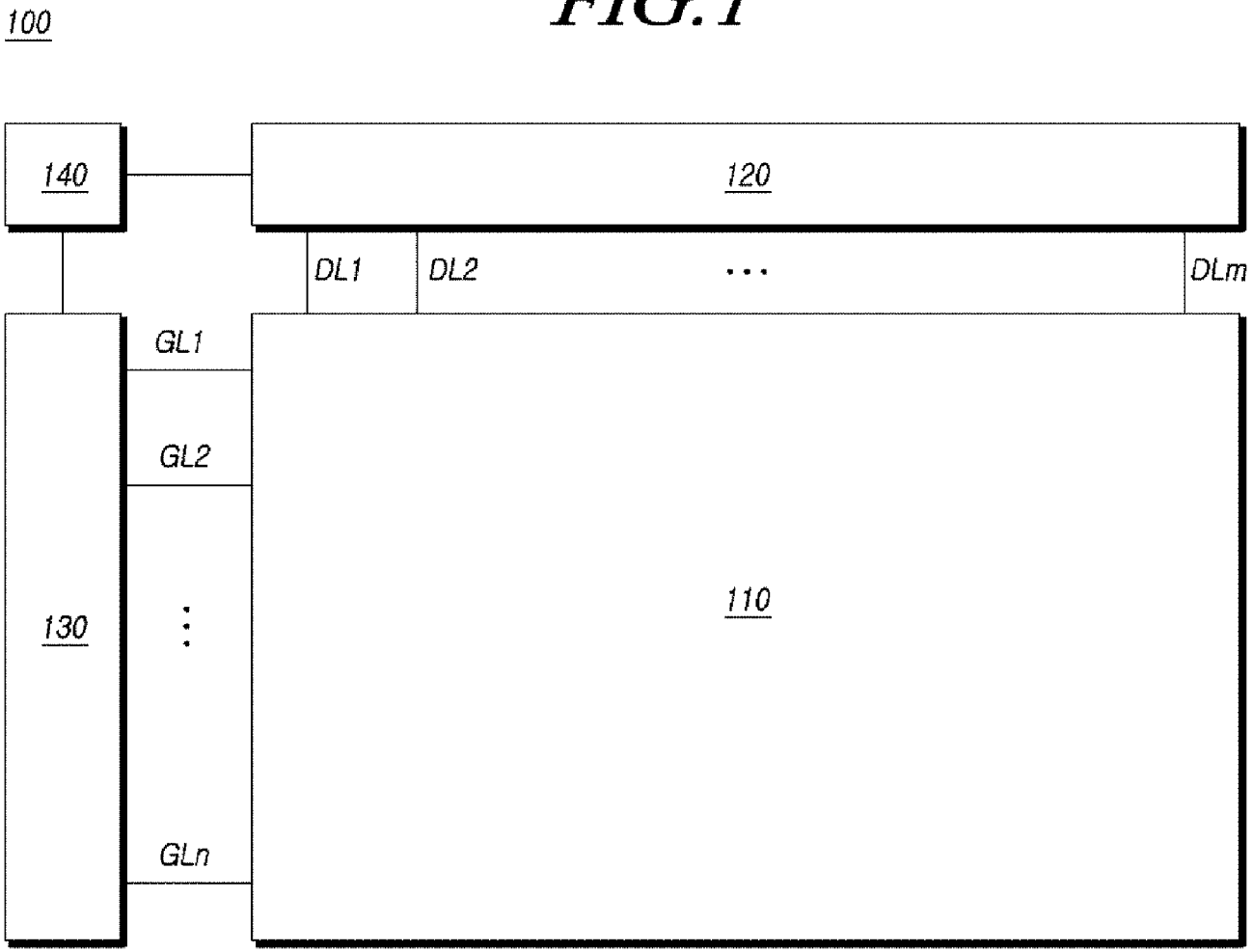
FIG. 1 is a schematic diagram illustrating the system configuration of a display device according to an exemplary embodiment of the present invention.

Reference will now be made in detail to the present invention, embodiments of which are illustrated in the accompanying drawings. Throughout this document, reference should be made to the drawings, in which the same reference numerals and signs may be used throughout the different drawings to designate the same or similar components. In the following description of the present invention, detailed descriptions of known functions and components incorporated herein will be omitted in the case that the subject matter of the present invention may be rendered unclear thereby.

It will also be understood that, although terms such as "first," "second," "A," "B," "(*a*)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but also can it be "indirectly connected or coupled to" the other element via an "intervening" element. In the same context, it will be understood that when an element is referred to as being formed "on" or "under" another element, not only can it be directly formed on or under another element, but also can it be indirectly formed on or under another element via an intervening element.

FIG. 1 is a schematic diagram illustrating the system configuration of a display device 100 according to an exemplary embodiment of the present invention. All the components of various display devices discussed below according to all embodiments of the present invention are operatively coupled and configured.

Referring to FIG. 1, the display device 100 according to an exemplary embodiment includes a display panel 110, a data driver 120, a gate driver 130 and a timing controller 140.

Data lines DL1, DL2, . . . , and DLm as well as gate lines GL1, GL2, . . . , and GLn are formed on the display panel 110, and subpixels (SPs) are formed at points where the data lines DL1 to DLm intersect the gate lines GL1 to GLn, respectively.

The data driver 120 supplies data voltages to the data lines DL1 to DLm. The data driver 120 includes two or more data driver integrated circuits (DICs) (200, see FIG. 2).

The gate driver 130 sequentially supplies scanning signals to the gate lines GL1 to GLn.

The timing controller 140 controls the data driver 120 and the gate driver 130.

In addition, each of the subpixels formed on the display panel 110 is provided with a circuit including at least one transistor. The circuit within each of the subpixels may further include other devices, such as at least one capacitor and at least one organic light-emitting diode (OLED), in addition to the at least one transistor depending on the design of the circuit or the type of the display device.

The display device 100 according to an exemplary embodiment provides a "pixel compensation function" to compensate for the difference in the luminance between the subpixels that is caused by a change or difference in the characteristics (e.g. a threshold voltage or mobility) between the transistors within the subpixels.

In addition, when a sensing result for pixel compensation is inaccurate even if the pixel compensation function is provided, the display device 100 according to an exemplary embodiment provides a "sensing unit compensation function" to compensate for the sensing result in order to achieve accurate pixel compensation.

In addition, the display device 100 according to an exemplary embodiment provides a "DIC output compensation function" to compensate for an output error of the data driver or a "deviation compensation function for each DIC" to compensate for an output deviation by monitoring the output of each DIC when the data driver includes two or more DICs.

Hereinafter, the "pixel compensation function" will be described first, and subsequently the necessity of the "sensing unit compensation function" and its operation will be described in detail with reference to the drawings.

The display device 100 according to an exemplary embodiment has a configuration for sensing the characteristics of the transistors of the circuits within the subpixels in order to provide the pixel compensation function.

Accordingly, the display panel 110 is provided with sensing lines (SL) connected to circuits within the subpixels. A single sensing line is provided for one or more rows of the subpixels.

The sensing lines may be disposed parallel to the data lines. In addition, a single sensing line may be provided on one subpixel row or two or more subpixel rows.

For example, when a shared structure, in which a single sensing line is provided for two or more subpixel rows, is applied, the single sensing line may be provided for three subpixel rows (a red subpixel row, a green subpixel row and a blue subpixel row). When a single pixel is made up of three subpixels (a red subpixel (R), a green subpixel (G) and a blue subpixel (B)), a single sensing line can be regarded as being provided for every pixel row.

For another example, a single sensing line can be provided for four subpixel rows (a red subpixel row, a white subpixel row, a green subpixel row and a blue subpixel row). That is, when a single pixel is made up of four subpixels (a red subpixel row (R), a white subpixel row (W), a green subpixel row (G) and a blue subpixel row (B)), a single sensing line can be regarded as being provided for every pixel row.

In addition, the display device 100 according to an exemplary embodiment can further include sensing units and a pixel compensation unit in addition to the sensing lines in order to provide the pixel compensation function. The sensing units convert sensed voltages Vsen measured through the sensing lines SL to digital sensed data Dsen. The pixel compensation unit converts data to be supplied to the subpixels for the pixel compensation based on the sensed data that has been sensed by and output from the sensing unit.

Hereinafter, the above-mentioned sensing units will also be referred to as analog-to-digital converters (ADCs). Although the ADCs may be disposed at any position within the display device 100, the ADCs will be described and illustrated as being disposed within the DICs, respectively, by way of example throughout the specification and the drawings.

In addition, although the above-mentioned pixel compensation unit may be disposed at any position within the display device 100, the pixel compensation unit will be described and illustrated by way of example as being disposed within the timing controller 140 throughout the specification and the drawings.

Figure 2:
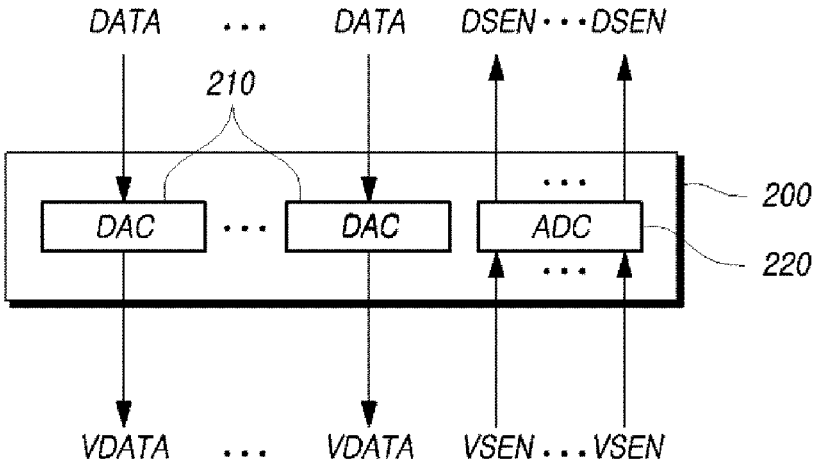
FIG. 2 is a schematic diagram illustrating one of the DICs of the data driver in the display device according to an exemplary embodiment of the present invention.

FIG. 2 is a schematic diagram illustrating one of the DICs 200 of the data driver 120 in the display device 100 according to an exemplary embodiment.

Referring to FIG. 2, each of the DICs 200 includes a driving section supplying data voltages Vdata to a plurality of subpixels that the DIC 200 controls and a sensing section for the plurality of subpixels.

Each of the DICs 200 includes a digital-to-analog converter (DAC) 210 that converts data input from the timing controller 140 to analog data Vdata.

Each of the DICs 200 further includes an ADC 220. The ADC 220 senses voltages Vsen in sensing nodes of circuits within the plurality of subpixels that the ADC 220 controls through two or more sensing lines (that may be conceptually identical to sensing channels), converts the sensed voltages Vsen to digital sensed data Dsen, and then outputs the digital sensed data Dsen.

As illustrated in FIG. 2, one DIC 200 includes one ADC 220. Therefore, when the display device 100 has two or more DICs 200, two or more ADCs 220 are provided in the display device 100.

The single ADC 220 of one DIC 200 is connected to two or more sensing lines SL, and senses voltages Vsen through the sensing lines.

Here, one sensing line SL connects the ADC 220 to one or more subpixels. Specifically, each sensing line of two or more sensing lines connected to one ADC 220 may be a line that senses a voltage in a sensing node of a circuit within one subpixel, or in a shared structure, a line that simultaneously or sequentially senses voltages in sensing nodes of circuits within two or more subpixels.

The ADC 220 of one DIC 200 outputs digital sensed data Dsen converted from the one or more sensed voltages Vsen that are measured through the one or more sensing channels corresponding to the two or more sensing lines.

Figure 3:
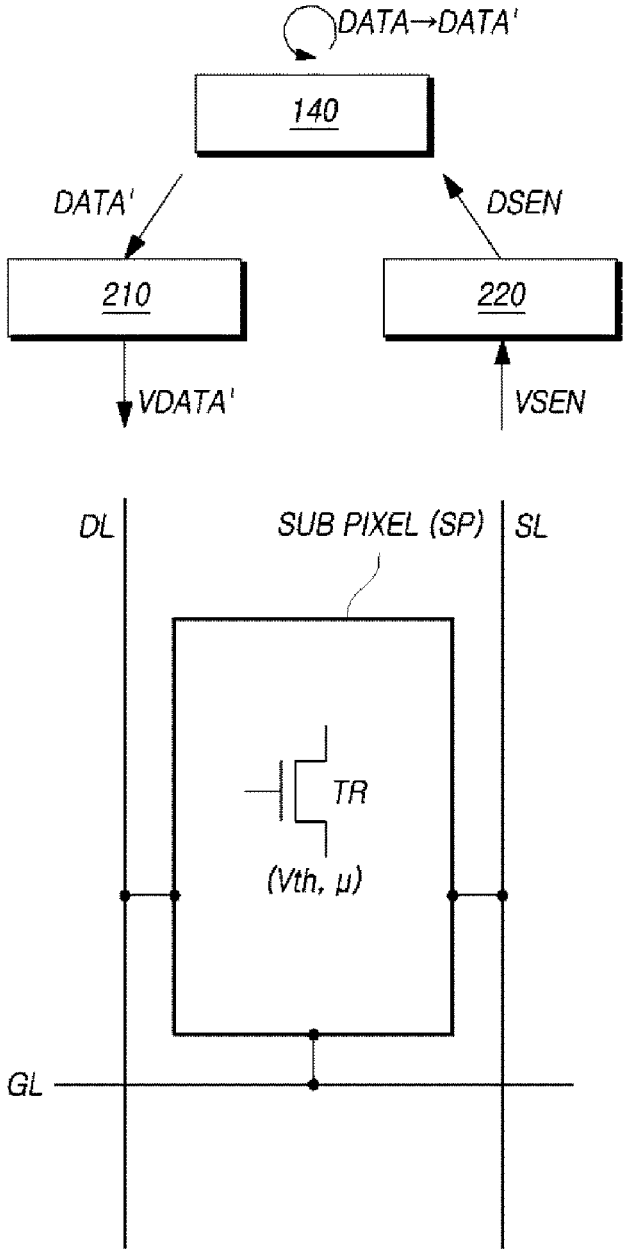
FIG. 3 and FIG. 4 are conceptual diagrams illustrating pixel compensation in the display device according to an exemplary embodiment of the present invention.

FIG. 3 is a conceptual diagram illustrating pixel compensation in the display device 100 according to an exemplary embodiment.

Referring to FIG. 3, the ADC 220 within the DIC 200 senses a voltage Vsen in a sensing node (e.g., a source or drain node of a transistor) on a circuit within a subpixel SP through a sensing line SL connected to the circuit within the subpixel SP, converts the sensed voltage to digital sensed data, and then outputs the digital sensed data.

The timing controller 140 changes data Data to be supplied to the subpixel SP using the sensed data Dsen and subsequently outputs changed data Data' in order to compensate for the characteristics (e.g., a threshold voltage Vth or mobility μ) of a transistor TR within the subpixel SP.

Consequently, the DAC 210 in the DIC 200 converts the changed data Data' to a data voltage Vdata' and subsequently outputs the data voltage Vdata'.

Accordingly, the data voltage Vdata' with which the characteristics of the transistor TR can be compensated is supplied to the subpixel SP through the data line DL, whereby the non-uniformity of the luminance of the subpixel SP can be prevented or reduced.

The pixel compensation that has been described in brief with reference to FIG. 3 will be described in greater detail with reference to FIG. 4 and FIG. 5.

Figure 4:
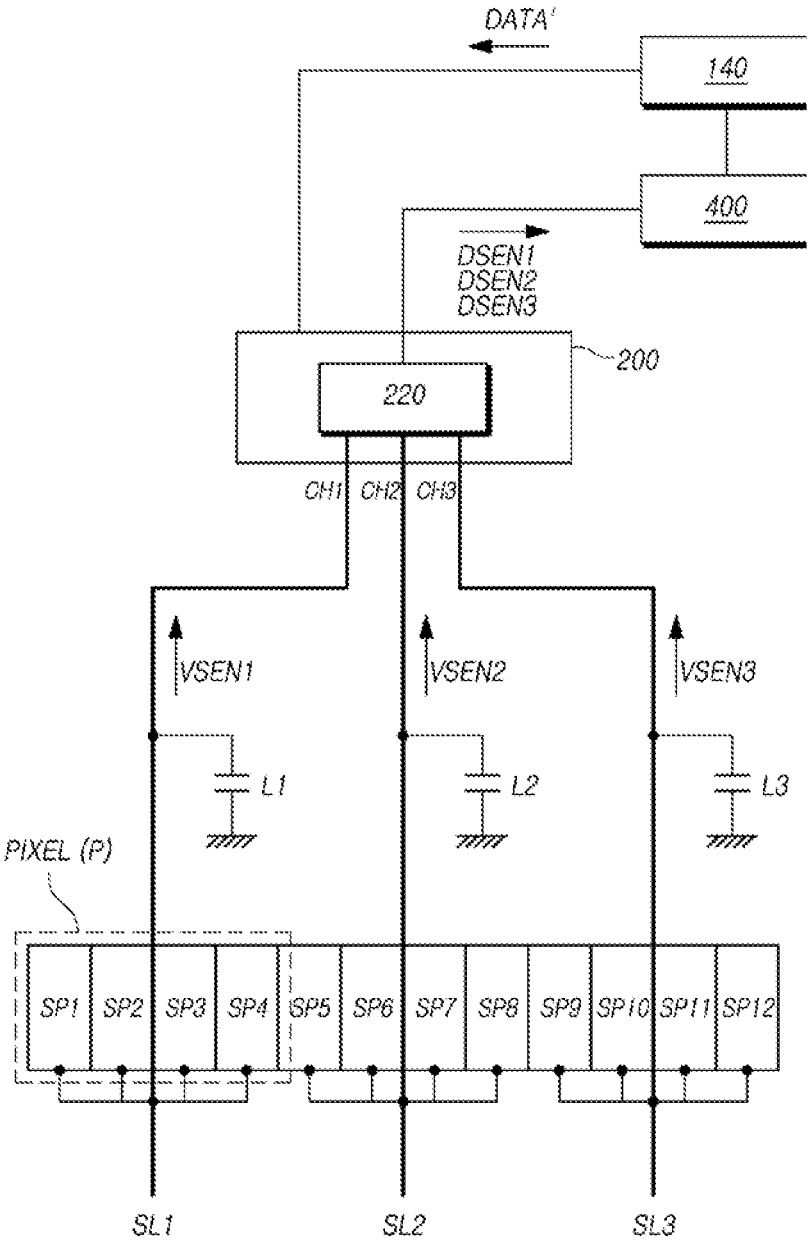
Figure 5:
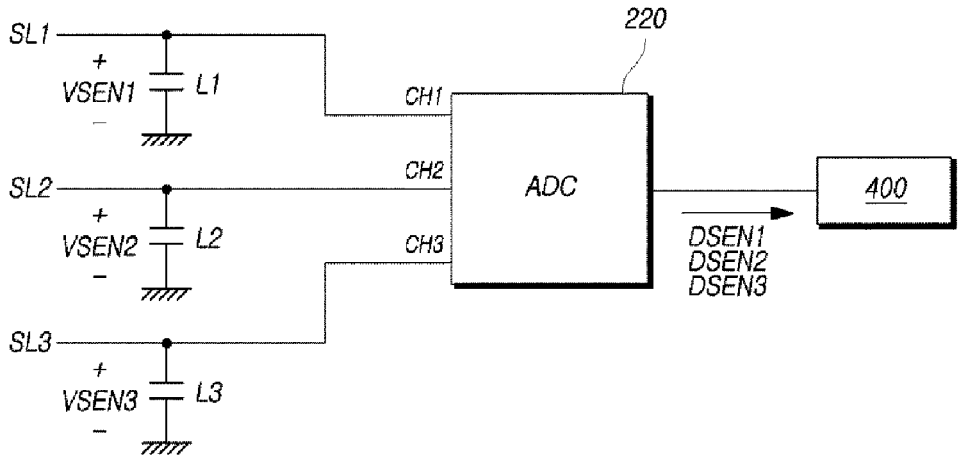
FIG. 5 is a conceptual diagram illustrating sensing and conversion functions of the ADC in the display device according to an exemplary embodiment of the present invention.

FIG. 4 is a diagram illustrating the pixel compensation in the display device 100 according to an exemplary embodiment, and FIG. 5 is a conceptual diagram illustrating sensing and conversion functions of the ADC 220 in the display device 100 according to an exemplary embodiment.

As illustrated in FIG. 4, one ADC 220 has three sensing channels CH1, CH2, and CH3. The three sensing channels CH1, CH2, and CH3 are connected to three sensing lines SL1, SL2, and SL3 in one-to-one correspondence. Each of the three sensing channels CH1, CH2 and CH3 is connected to four subpixels SP. Specifically, the sensing channel CH1 and the corresponding sensing line SL1 are connected to and shared by the subpixels SP1, SP2, SP3, and SP4. The sensing channel CH2 and the corresponding sensing line SL2 are connected to and shared by the subpixels SP5, SP6, SP7, and SP8. The sensing channel CH3 and the corresponding sensing line SL3 are connected to and shared by the subpixels SP9, SP10, SP11, and SP12. Four subpixels SP constitute a single pixel P.

For example, the four subpixels SP may include a red subpixel (R), a white subpixel (W), a green subpixel (G), and a blue subpixel (B). For example, the subpixels SP1, SP5, and SP9 may be the red subpixels (R), the subpixels SP2, SP6, and SP10 may be the white subpixels (W), the subpixels SP3, SP7, and SP11 may be green subpixels (G), and the subpixels SP4, SP8, and SP12 may be the blue subpixels (B).

Referring to FIG. 4, the ADC 220 senses a voltage Vsen at a sensing node in each subpixel SP through the three sensing lines SL1, SL2, and SL3 at one point of time.

For example, at a first point of time, the ADC 220 can sense a voltage Vsen1 at a sensing node of a circuit within one subpixel, for example, the subpixel SP1, from among the four subpixels SP1, SP2, SP3, and SP4 connected to the sensing line SL1 through the sensing line SL1.

In addition, the ADC 220 can sense a voltage Vsen2 at a sensing node of a circuit within one subpixel, for example, the subpixel SP5, from among the four subpixels SP5, SP6, SP7, and SP8 connected to the sensing line SL2 through the sensing line SL2. Furthermore, the ADC 220 can sense a voltage Vsen3 at a sensing node of a circuit within one subpixel, for example, the subpixel SP9, from among the four subpixels SP9, SP10, SP11, and SP12 connected to the sensing line SL3 through the sensing line SL3. After the first point of time, at a second point of time, the ADC 220 can sense a voltage Vsen1 at a sensing node of a circuit within another subpixel, for example, the subpixel SP2, from among the four subpixels SP1, SP2, SP3, and SP4 connected to the sensing line SL1 through the sensing line SL1.

In addition, the ADC 220 can sense a voltage Vsen2 at a sensing node of a circuit within another subpixel, for example, the subpixel SP6, from among the four subpixels SP5, SP6, SP7, and SP8 connected to the sensing line SL2 through the sensing line SL2.

Furthermore, the ADC 220 can sense a voltage Vsen3 in a sensing node of a circuit within another subpixel, for example, the subpixel SP10, from among the four subpixels SP9, SP10, SP11, and SP12 connected to the sensing line SL3 through the sensing line SL3.

In other words, at the first point of time, the ADC 220 can simultaneously sense the voltages Vsen1, Vsen2, and Vsen3 at the sensing nodes within the circuits of the subpixels SP1, SP5, and SP9 corresponding to the red subpixels (R) through the sensing lines SL1, SL2, and SL3. At the second point of time, the ADC 220 can simultaneously sense the voltages Vsen1, Vsen2, and Vsen3 at the sensing nodes within the circuits of the subpixels SP2, SP6, and SP10 corresponding to the white subpixels (W) through the sensing lines SL1, SL2, and SL3. In addition, at a third point of time, the ADC 220 can simultaneously sense voltages Vsen1, Vsen2, and Vsen3 at sensing nodes within circuits of the subpixels SP3, SP7, and SP11 corresponding to the green subpixels (G) through the sensing lines SL1, SL2, and SL3. Furthermore, at a fourth point of time, the ADC 220 can simultaneously sense voltages Vsen1, Vsen2, and Vsen3 at sensing nodes within circuits of the subpixels SP4, SP8, and SP12 corresponding to the blue subpixels (B), through the sensing lines SL1, SL2, and SL3.

Referring to FIG. 4 and FIG. 5, latches L1, L2, and L3 are connected to the three sensing lines SL1, SL2, and SL3, respectively. The voltages Vsen sensed at the sensing nodes within the corresponding subpixels are stored in the latches L1, L2, and L3.

Specifically, the voltage Vsen1 sensed at the sensing node within a subpixel to be sensed from among the four subpixels SP1, SP2, SP3, and SP4 connected to the sensing line SL1 is stored in the latch L1 connected to the sensing line SL1. The sensed voltage Vsen2 sensed at the sensing node within the subpixel from among the four subpixels SP5, SP6, SP7, and SP8 connected to the sensing line SL2 is stored in the latch L2 connected to the sensing line SL2. The voltage Vsen3 sensed at the sensing node within the subpixel to be sensed from among the four subpixels SP9, SP10, SP11, and SP12 connected to the sensing line SL3 is stored in the latch L3 connected to the sensing line SL3. Each of the above-mentioned latches L1, L2, and L3 may be implemented as a capacitor, as illustrated in FIG. 4.

Referring to FIG. 4 and FIG. 5, the ADC 220 can simultaneously or sequentially measure the sensed voltages Vsen1, Vsen2, and Vsen3 through the three sensing channels CH1, CH2, and CH3 by reading in the voltages Vsen1, Vsen2, and Vsen3 stored in the three latches L1, L2, and L3.

The ADC 220 converts the voltages Vsen1, Vsen2, and Vsen3 sensed through the sensing channels CH1, CH2, and CH3 to digital sensed data, outputs the converted sensed data Dsen1, Dsen2, and Dsen3, and then stores the data Dsen1, Dsen2, and Dsen3 in memory 400.

Referring to FIG. 4, the timing controller 140 reads the sensed data Dsen1, Dsen2, and Dsen3 that have been sensed by the ADC 220 and stored in the memory 400 as described above, changes data Data to be supplied to the subpixels into data Data', and then outputs the changed data Data' to the DIC 200.

Consequently, the DIC 200 receives the changed data Data', converts the changed data Data' to analog data voltages Vdata', and then supplies the analog data voltages Vdata' to the corresponding subpixels via an output buffer (not shown).

Figure 6:
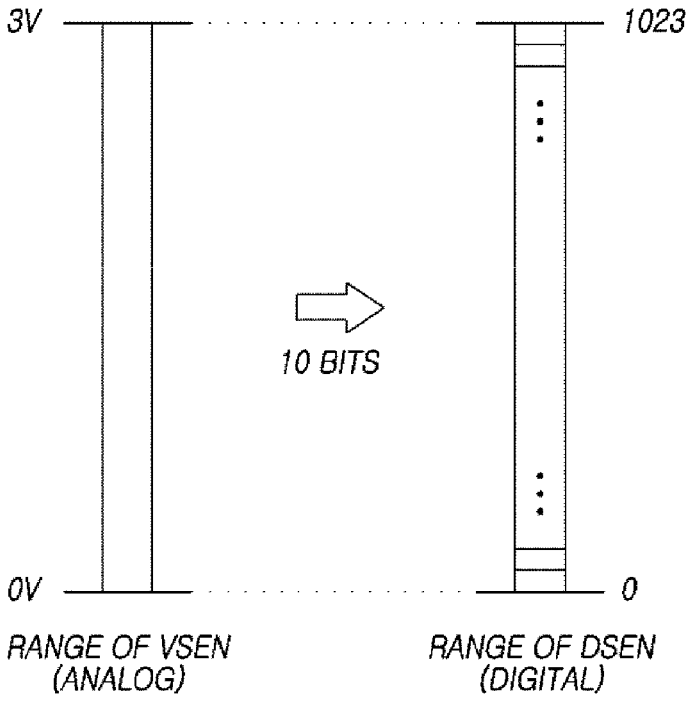
FIG. 6 is a diagram illustrating the range of an input voltage and the range of output data of the ADC in the display device according to an exemplary embodiment of the present invention.

FIG. 6 is a diagram illustrating the range of an input voltage Vsen and the range of output data Dsen of the ADC 220 in the display device 100 according to an exemplary embodiment.

Referring to FIG. 6, for example, the input voltage of the ADC 220 ranges from 0 V to 3 V, and the output data of the ADC 220 ranges from 0 to 1023 corresponding to 10 bits. That is, the ADC 220 converts the voltage Vsen within the input voltage range from 0 V to 3 V to the digital data Dsen within the output data range from 0 to 10123 that can be expressed by 10 bits.

Figure 7:
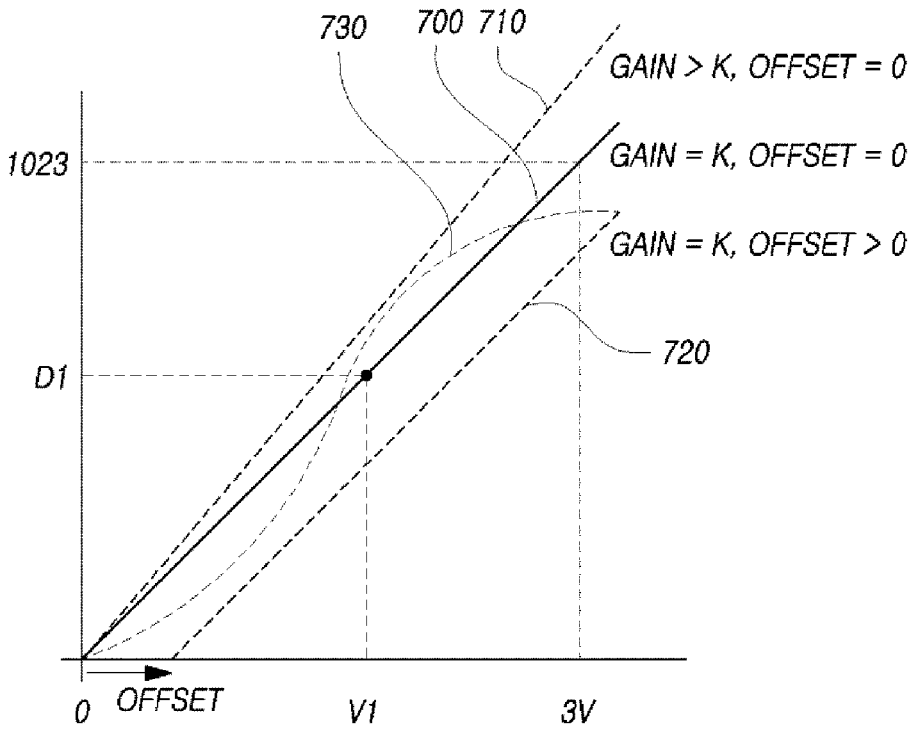
FIG. 7 is a graph illustrating the input-output relationship and the characteristics information of the ADC in the display device according to an exemplary embodiment of the present invention.

The input-output relationship of the ADC 220 can be expressed on a graph (x axis: input voltage, y axis: output voltage), as illustrated in FIG. 7.

FIG. 7 is a graph illustrating the input-output relationship and the characteristics information of the ADC 220 in the display device 100 according to an exemplary embodiment.

Referring to FIG. 7, the input-output relationship of the ADC 220 can be ideally defined along a straight line 700 that connects a point (0, 0) where an input voltage is 0 V and output data is 0 and a point (3, 1023) where an input voltage is 3 V and output data is 1023.

This ideal ADC 220 can have ideal linear ADC characteristics where a gain corresponding to the incline is k (=1023/3V) and an offset corresponding to an x-intercept is 0.

In addition, although the ADC 220 has the linear ADC characteristic, the linear ADC characteristics of the ADC 220 can differ from the ideal linear characteristics of the straight line 700. In practice, the linear ADC characteristics of the ADC 220 can be expressed by a straight line 710 where a gain corresponding to an incline is greater than k.

In practice, the linear ADC characteristics of the ADC 220 can be expressed by a straight line (not shown) where a gain corresponding to an incline is smaller than k.

In addition, in practice, the ADC 220 can have linear ADC characteristics expressed by a straight line 720 where an offset corresponding to an x-intercept is greater than 0 instead of the straight line 700 that exhibits the ideal linear characteristics.

In practice, the linear ADC characteristics of the ADC 220 can be expressed by a straight line (not shown) where an offset corresponding to an x-intercept is smaller than 0.

In practice, the ADC 220 can have non-linear ADC characteristics expressed by a curved line 730 illustrated in FIG. 7 instead of having the linear ADC characteristics corresponding to the tendencies of the input-output relationships defined by the above-mentioned straight lines 700, 710, and 720.

As described above, regarding the ADC characteristics of the ADC 220, the phenomenon where a gain differs from an ideal gain (=k), an offset differs from an ideal offset (=0), or the line is non-linear may be an actual phenomenon that occurs without any external factor or a phenomenon that is caused by an external factor.

The ADC characteristics of the ADC 220 may be changed by an external factor, for example, where the ADC 220 or the DIC 200 or display device 100 including the ADC 220 operates for an extended period of time, the temperature of the ADC 220 or the DIC 200 or display device 100 including the ADC 220 is increased, or the ADC 220 or the DIC 200 or display device 100 including the ADC 220 is subjected to a high pressure.

As described above, when there is a change in the ADC characteristics of the ADC 220, the ADC characteristics of each ADC 220 may differ according to the sensing channels or the ADC characteristics of one ADC 220 may differ from those of the other ADC 220.

That is, the change in the ADC characteristics may include at least one of the difference in the characteristics between the ADCs 220 or the difference in the characteristics between sensing channels of each ADC 220.

This change in the ADC characteristic will be described again with reference to FIG. 8 and FIG. 9.

Figure 8:
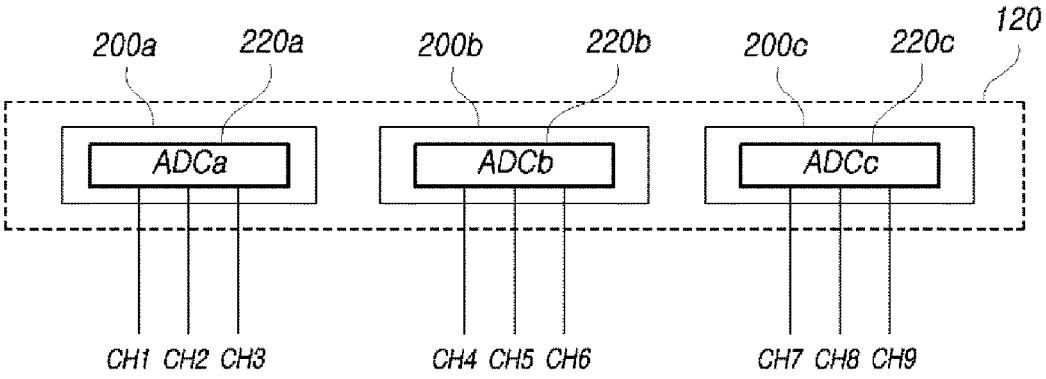
FIG. 8 is a diagram illustrating the data driver including three DICs in the display device (100) according to an exemplary embodiment of the present invention.
Figure 9:
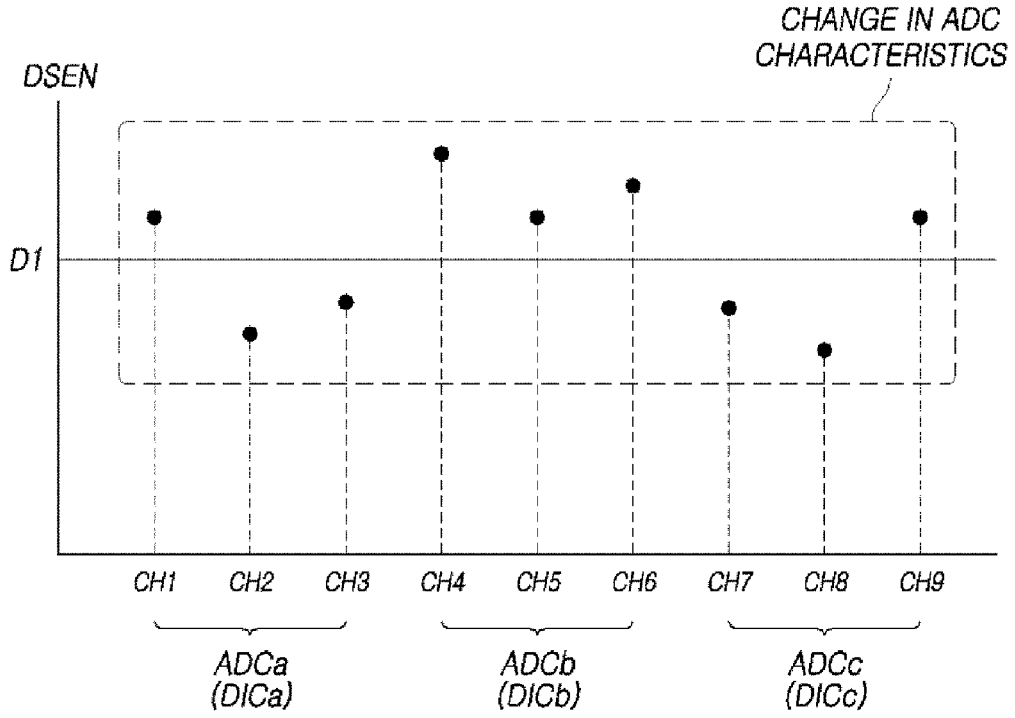
FIG. 9 is a diagram illustrating changes in the ADC characteristics in the display device according to an exemplary embodiment of the present invention.

FIG. 8 is a diagram illustrating the data driver 120 including three DICs 200*a*, 200*b*, and 200*c* in the display device 100 according to an exemplary embodiment. FIG. 9 is a diagram illustrating changes in the ADC characteristics in the display device 100 according to an exemplary embodiment.

In order to study changes in the ADC characteristics, as illustrated in FIG. 8, the data driver 120 will be described by way of example as including the three DICs 200*a*, 200*b*, and 200*c*.

Each of the three DICs 200*a*, 200*b*, and 200*c* includes one ADC 220 (ADCa, ADCb, ADCc). Specifically, the first DIC 200*a* (DICa) includes the ADC 220*a* (ADCa), the second DIC 200*b* (DICb) includes the ADC 220*b* (ADCb), and the third DIC 200*c* (DICc) includes the ADC 220*c* (ADCc).

Referring to FIG. 8, for example, the ADC 220*a* (ADCa) has three sensing channels CH1, CH2, and CH3 corresponding to three sensing lines, the ADC 220*b* (ADCb) has three sensing channels CH4, CH5, and CH6 corresponding to three sensing lines, and the ADC 220*c* (ADCc) has three sensing channels CH7, CH8, and CH9 corresponding to three sensing lines.

Referring to FIG. 9, the same voltage V1 is input to the three sensing channels CH1, CH2, and CH3 of the ADC 220*a* (ADCa), and in response to the same voltage V1, output data Dsen are extracted from the three sensing channels CH1, CH2, and CH3. Likewise, the same voltage V1 is input to the three sensing channels CH4, CH5, and CH6, and in response to the same voltage V1, output data Dsen are extracted from the three sensing channels CH4, CH5, and CH6. In the same manner, the same voltage V1 is input to the three sensing channels CH7, CH8, and CH9, and in response to the same voltage V1, output data Dsen are extracted from the three sensing channels CH7, CH8, and CH9.

When the output data Dsen extracted from the nine sensing channels CH1 to CH9 as above can be expressed as in FIG. 9, it is apparent that the output data Dsen from the nine sensing channels CH1 to CH9 are different from each other. In other words, the sensing channels of each ADC 220 output different data, and the ADCs 220 also output different data.

In FIG. 9, the straight line having output data D1 indicates output data that have ideal linear ADC characteristics when an input voltage is V1.

As described above, when there is a change in the ADC characteristic for any reason, there occurs a problem in that the voltage Vsen sensed for pixel compensation is not converted into accurate sensed data Dsen. Consequently, pixel compensation may not be properly performed, thereby failing to overcome the non-uniform luminance of the subpixels.

Therefore, this embodiment provides a function of compensating for a change in ADC characteristics (hereinafter referred to as the "ADC compensation function") by which accurate sensed data can be obtained regardless of a change in the ADC characteristics.

A more detailed description will be given below of the ADC compensation function by which accurate sensed data can be obtained regardless of a change in the ADC characteristics.

Figure 10:
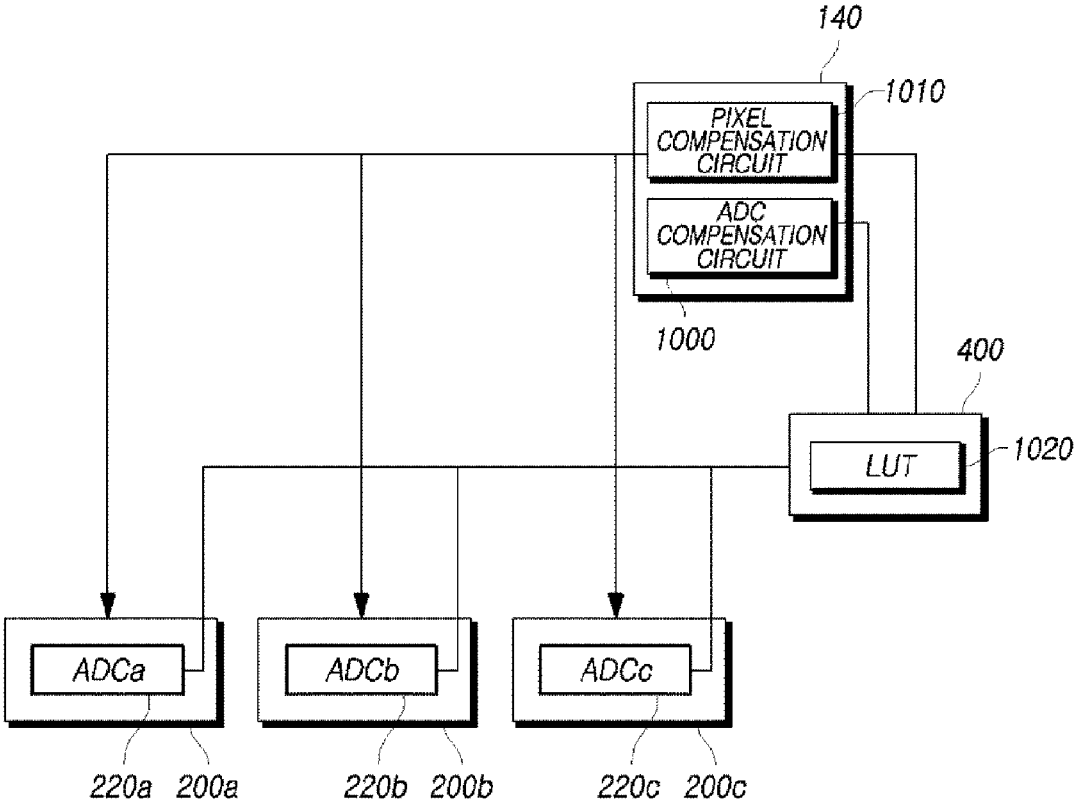
FIG. 10 is a schematic diagram illustrating a configuration for compensating for a change in the ADC characteristics in the display device according to an exemplary embodiment of the present invention.
Figure 11:
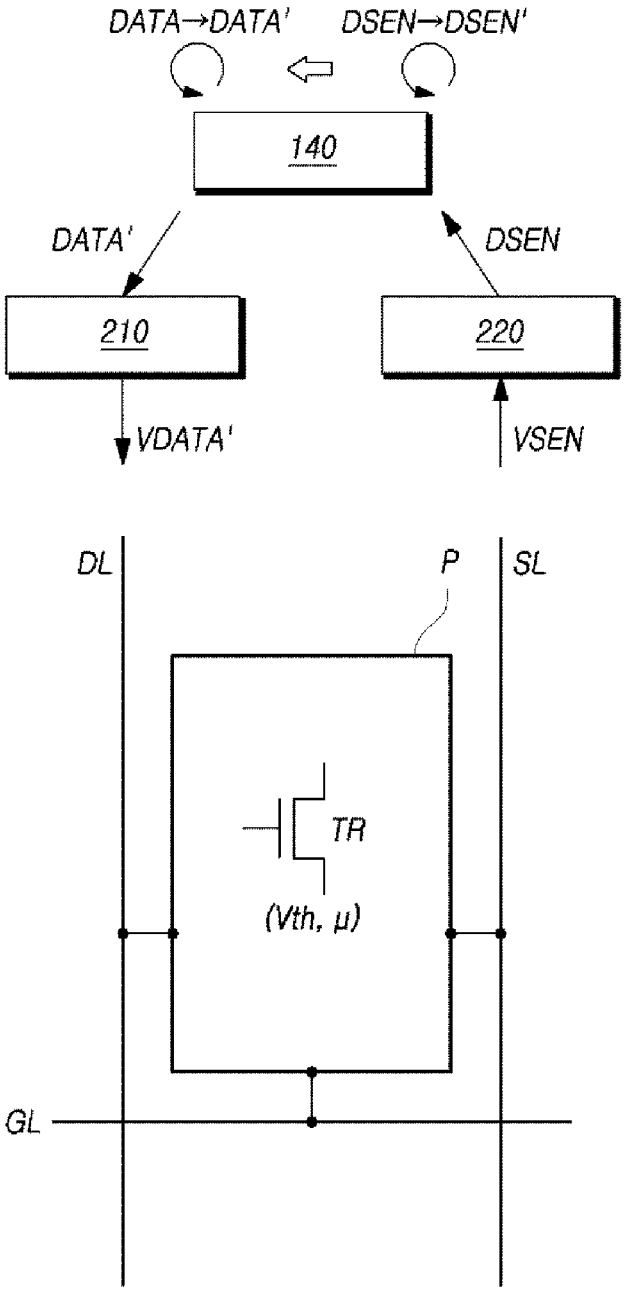
FIG. 11 is a conceptual diagram illustrating pixel compensation to which ADC compensation is applied in the display device 100 according to an exemplary embodiment of the present invention.

FIG. 10 is a schematic diagram illustrating a configuration for compensating for a change in the ADC characteristics in the display device 100 according to an exemplary embodiment, and FIG. 11 is a conceptual diagram illustrating pixel compensation to which ADC compensation is applied in the display device 100 according to an exemplary embodiment.

Referring to FIG. 10, the display device 100 according to an exemplary embodiment includes an ADC compensation circuit 1000 and a pixel compensation circuit 1010. The ADC compensation circuit 1000 and the pixel compensation circuit 1010 can be components of the timing controller 140. However, they might be realized as a single unit and might be located outside the timing controller in another unit or as a separate unit.

When there is a change in the ADC characteristics, the ADC compensation circuit 1000 performs ADC compensation by updating a lookup table (LUT) 1020 that includes ADC characteristics information according to the sensing channels such that the change in the ADC characteristics including at least one of the difference in the characteristics between the ADCs 220 and the difference in the characteristics between the sensing channels within each ADC 220 can be compensated.

Referring to FIG. 10 and FIG. 11, the pixel compensation circuit 1010 of the timing controller 140 performs the pixel compensation such that the characteristics (e.g., a threshold voltage Vth or mobility μ) of the transistor within each subpixel is compensated based on the changed sensed data Dsen' of the sensed data Dsen according to the lookup table 1020 updated by the ADC compensation circuit 1000.

Accordingly, based on the changed sensed data Dsen' according to the lookup table 1020 updated by the ADC compensation circuit 1000, the timing controller 140 changes data Data to be supplied to the subpixels SP to data Data', and outputs the changed data Data'. Then, the DAC 210 within the DIC 200 converts the changed data Data' to data voltages Vdata' and subsequently outputs the data voltages Vdata'. The converted data voltages Vdata' are supplied to the corresponding subpixels SP.

Referring to FIG. 10 and FIG. 11, even if the sensed data Dsen output from the ADC 220 are inaccurate due to a change in the ADC characteristics, the sensed data Dsen are compensated, and the pixel compensation is performed using the changed sensed data Dsen' that has been compensated. It is therefore possible to remove the inaccuracy from the sensed data and the pixel compensation caused by the change in the ADC characteristics.

The above-described ADC compensation circuit 1000 senses a change in the ADC characteristics (a change in the ADC characteristic information) if the sensed data Dsen obtained by the two or more ADCs 220 differ from the reference data previously stored in the memory. In this case, the ADC compensation circuit 1000 can enhance the accuracy with which the change in the ADC characteristics is sensed by further considering at least one of temperature change information and pressure change information received from the sensors (not shown).

After the change in the ADC characteristic is sensed, the ADC compensation circuit 1000 can perform ADC compensation to update the lookup table 1020 by changing at least one piece of information (e.g., an offset) from among the ADC characteristics information according to the sensing channels (e.g., offsets or gains) included in the lookup table 1020 in order to compensate for the change in the ADC characteristics.

This ADC compensation can be performed in response to a signal indicating that the display device 100 is powered-off or can be performed in real time while the display device 100 is being powered on.

Herein, the "ADC compensation" is referred to as real-time data driver IC sensing (hereinafter referred to as "RTDS").

Alternatively or additionally, the pixel compensation may be performed in real time to compensate for the mobility μ of the transistors within the subpixels.

Here, the pixel compensation intended to compensate for the mobility in real time while the display device 100 is being powered on is referred to as real-time (hereinafter referred to as "RT") compensation.

For the above-described RT compensation, the timing controller 140 can control the pixel compensation (RT compensation) to compensate for the mobility of the transistor of each subpixel in a blank time on a vertical synchronous signal Vsync.

In addition, the timing controller 140 controls ADC compensation (i.e., RTDS) in response to a signal indicating that the display device 100 is powered-off, and subsequently, controls pixel compensation to compensate for the threshold voltage of the transistor within each subpixel.

The pixel compensation of compensating for the threshold voltage of the transistor within each subpixel in response to the signal indicating that the display device 100 is powered-off is referred to as "off real-time sensing" (hereinafter referred to as "OFF RS").

Although the ADC compensation (i.e., the RTDS) can be performed in response to the signal indicating that the display device 100 is powered off as described above, the ADC compensation can be performed in real time while the display device 100 is being powered on.

As such, when the ADC compensation is performed in real time while the display device 100 is being powered on, it is required to control the timing for the RT compensation corresponding to the pixel compensation that is performed in real time while the display device 100 is being powered on and timing for the RTDS corresponding to the ADC compensation.

Therefore, the timing controller 140 controls the timing such that both the pixel compensation (RT compensation) and the ADC compensation (RTDS) are performed before a power-off signal of the display device 100 is generated, i.e., while the display device 100 is being turned on.

For example, the timing controller 140 may control the ADC compensation to be performed in at least one blank time from among several blank times on the vertical synchronous signal Vsync in a single frame before the power-off signal of the display device 100 is generated, and may control the pixel compensation to be performed in the remaining blank times.

As such, when the ADC compensation (RTDS) is already performed in real time while the display device 100 is being turned on, the timing controller 140 controls the pixel compensation to be performed such that the threshold voltage of the transistor within each subpixel (OFF RS) is compensated without performing the ADC compensation (i.e., RTDS) when the power-off signal is generated.

In addition, the above-mentioned lookup table 1020 includes offsets and gains according to the sensing channels for each of two or more ADCs 220, the offsets and gains being included in the ADC characteristics information defining the input-output relationship.

When the lookup table 1020 is updated by the ADC compensation circuit 1000, at least one (e.g., an offset) of offsets and gains of the ADC characteristic information can be changed.

The voltage Vsen sensed at the ADC 220 while sensing a threshold voltage is higher than the voltage Vsen sensed at the ADC 220 while sensing mobility. The input voltage Vsen of the ADC 220 during the threshold voltage sensing is higher than the input voltage Vsen of the ADC 220 during the mobility sensing. Therefore, the lookup table 1020 that is to be referred to for the threshold voltage sensing must differ from the lookup table 1020 that is to be referred to for the mobility sensing.

Accordingly, the lookup table 1020 stored in the memory 400 includes a first lookup table for threshold voltage sensing mode and a second lookup table for mobility sensing mode, the second lookup table being separate from the first lookup table.

As described above, the change in the ADC characteristics may be a change in the characteristics between the ADCs 220 or between the sensing channels within each ADC 220.

Herein, two compensation methods are disclosed as the ADC compensation by which a change in the ADC characteristic is compensated. One method compensates for a change in the ADC characteristic according to the DICs (hereinafter referred to as "DIC-specific ADC compensation" or "first ADC compensation"). The other method compensates for a change in the ADC characteristic according to the sensing channels (hereinafter referred to as "CH-specific compensation" or "second ADC compensation").

Figure 12A:
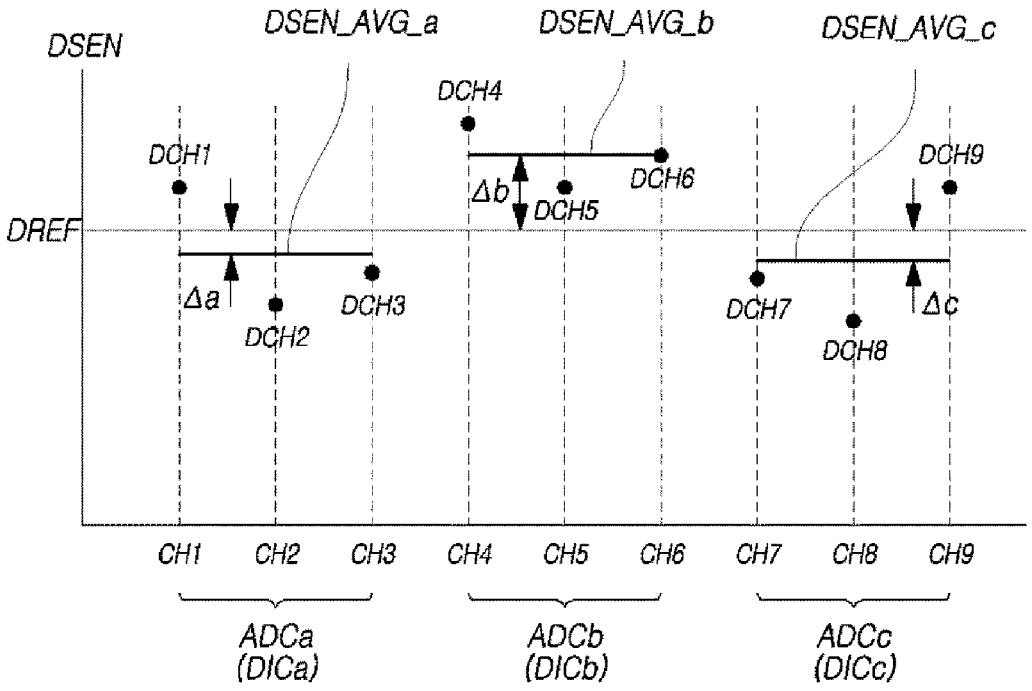
FIG. 12A and FIG. 12B are diagrams illustrating two ADC compensation methods in the display device according to an exemplary embodiment of the present invention.
Figure 12B:
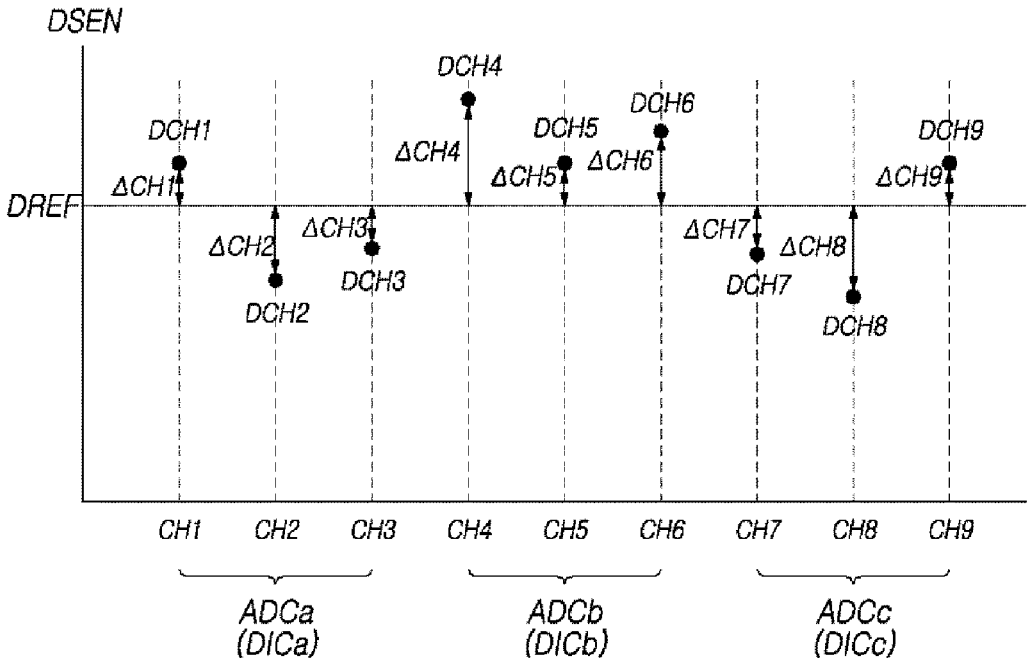

FIG. 12A and FIG. 12B are diagrams illustrating the two ADC compensation methods in the display device 100 according to an exemplary embodiment.

FIG. 12A is a diagram conceptually illustrating the first ADC compensation for a change in the ADC characteristics according to the DICs 200.

Referring to FIG. 12A, even if the sensed data differ according to the sensing channels of one DIC, the sensed data Dsen are changed by the same amount of compensation for all of the sensing channels of one DIC 200 based on the difference Δ between one average sensed data Dsen_avg obtained by averaging the sensed data according to the sensing channels and preset reference data Dref.

Referring to FIG. 12A, a description will be given of the ADC compensation in the first data DIC 200*a* (DICa), i.e., in the ADC 220*a* (ADCa). The ADC 220*a* (ADCa) of the first DIC 200*a* (DICa) receives the same voltage as an input for three sensing channels CH1, CH2, and CH3, outputs three sets of different sensed data Dch1, Dch2, and Dch3, and stores the three sets of different sensed data Dch1, Dch2, and Dch3 in the memory 400.

The ADC compensation circuit 1000 obtains average sensed data Dsen_avg_a by averaging the three sets of different sensed data Dch1, Dch2, and Dch3, and calculates the difference Δa between the average sensed data Dsen_avg_a and the reference data Dref previously stored in the memory 400.

The ADC compensation circuit 1000 updates the lookup table 1020 by adding or deducting the same amount of compensation Δa to or from the ADC characteristics information (e.g., offset) of each of the three sensing channels CH1, CH2, and CH3 of the ADC 220*a* (ADCa) stored in the lookup table 1020.

It is appreciated that the three sets of sensed data Dch1, Dch2, and Dch3 for the three sensing channels CH1, CH2, and CH3 of the ADC 220*a* (ADCa) are compensated by the same amount of compensation Δa even if the three sets of sensed data Dch1, Dch2, and Dch3 are different from each other. This, however, fails to reflect the difference in the characteristics between the sensing channels, which is problematic.

Referring to FIG. 12A, in the ADC 220*b* (ADCb) which is a component of the second DIC 200*b* (DICb), three sets of sensed data Dch4, Dch5, and Dch6 for the three sensing channels CH4, CH5, and CH6 of the ADC 220*b* (ADCb) are compensated by the same amount of compensation Δa even if the three sets of sensed data Dch4, Dch5, and Dch6 are different from each other, as in the ADC compensation in the ADC 220*a* (ADCa) of the first DIC 200*a* (DICa).

In addition, in the ADC 220*c* (ADCc) which is a component of the third DIC 200*c* (DICc), three sets of sensed data Dch7, Dch8, and Dch9 for the three sensing channels CH7, CH8 and CH9 are also compensated by the same amount of compensation Δa even if the three sets of sensed data Dch7, Dch8, and Dch9 are different from each other.

In FIG. 12A, it is assumed that all reference data Dref shall be the same for all of the sensing channels CH1 to CH9.

The first ADC compensation method has advantages in that the amount of data is reduced since it is required to store only one piece of reference data for each DIC and that the amount of calculation is reduced since the comparison of data for the update of the lookup table is performed according to the DICs. That is, the first ADC compensation method leads to efficient ADC compensation.

Unlike the first ADC compensation method, the second ADC compensation method performs the ADC compensation according to the sensing channels, which will be described below with reference to FIG. 12B.

Referring to FIG. 12B, the second ADC compensation method does not average the sensed data according to the sensing channels, but separately changes the sensed data Dsen according to the sensing channels by determining an amount of compensation for each of the sensing channels based on the difference Δ between predetermined reference data Dref for the sensing channels.

With reference to FIG. 12B, a description will be given of the ADC compensation in the first DIC 200*a* (DICa), i.e., in the ADC 220*a* (ADCa). The ADC 220*a* (ADCa) which is a component of the first DIC 200*a* (DICa) receives the same voltage for three sensing channels CH1, CH2, and CH3, outputs three sets of different sensed data Dch1, Dch2, and Dch3, and stores the three sets of different sensed data Dch1, Dch2, and Dch3 in the memory 400.

The ADC compensation circuit 1000 calculates differences Δch1, Δch2, and Δch3 between the three sets of different sensed data Dch1, Dch2, and Dch3 and the reference data Dref previously stored in the memory 400.

The ADC compensation circuit 1000 updates the lookup table 1020 by adding or deducting corresponding compensation amounts Δch1, Δch2, and Δch3 to or from the ADC characteristic information (e.g., offset) of the three sensing channels CH1, CH2, and CH3 of the ADC 220*a* (ADCa) stored in the lookup table 1020.

It is appreciated that the three sets of sensed data Dch1, Dch2, and Dch3 for the three sensing channels CH1, CH2, and CH3 are compensated by individual compensation amounts Δch1, Δch2, and Δch3.

Accordingly, unlike the first ADC compensation method, the second ADC compensation method can more accurately compensate for the sensed data by reflecting the difference in the characteristics between the sensing channels, whereby the pixel compensation can be performed more precisely.

Figure 13:
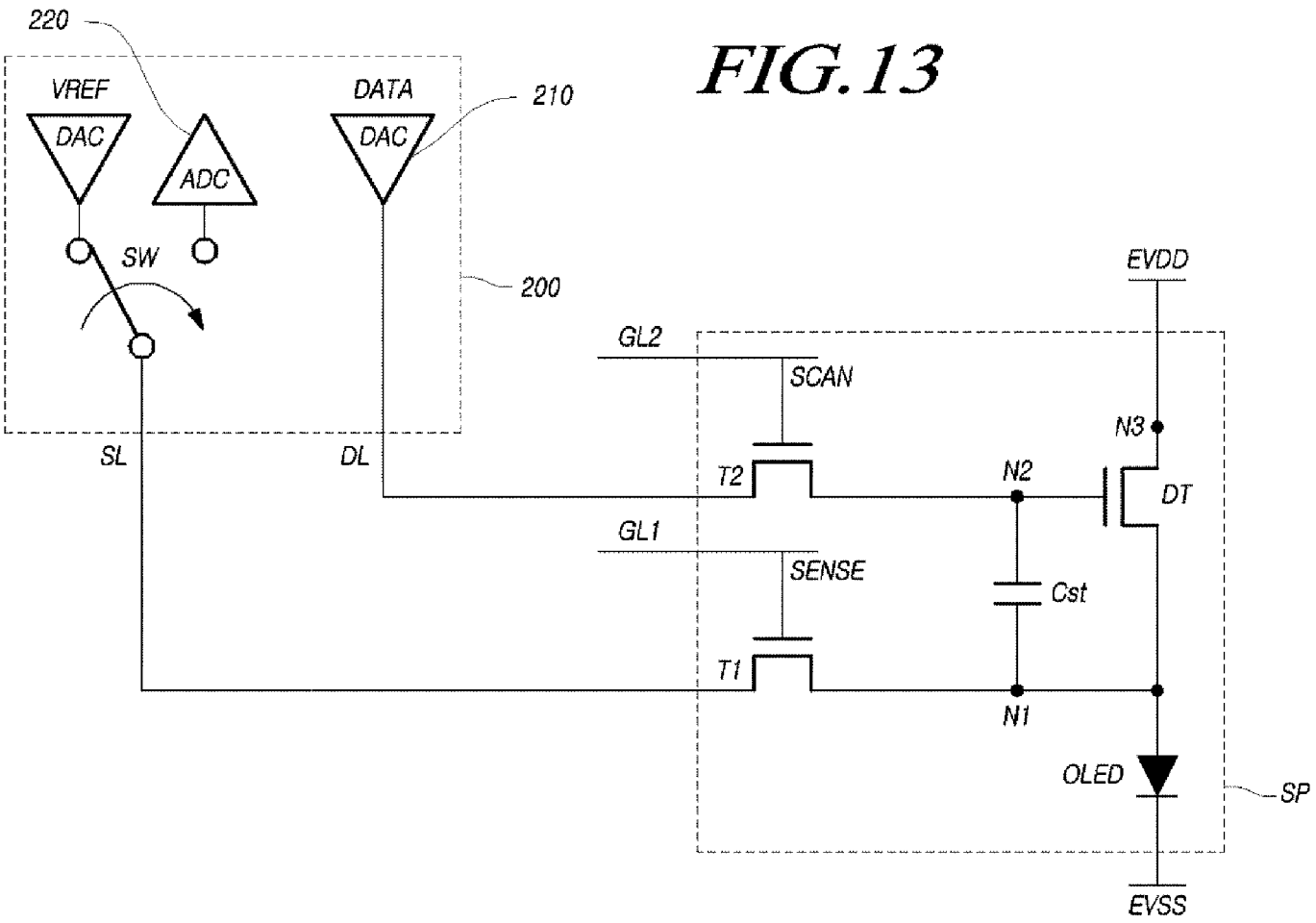
FIG. 13 is a diagram illustrating a subpixel structure, an ADC and a sensing line when the display device according to an exemplary embodiment of the present invention is an OLED display device.

Referring to FIG. 13, when the display device 100 according to an exemplary embodiment is an OLED display device, each of the subpixels includes an OLED, a driving transistor DT, a first transistor T1, a second transistor T2 and a capacitor Cst. The driving transistor DT drives the OLED. The first transistor T1 is controlled by a first scanning signal SENSE supplied through a first gate line GL1, and is connected between a line SL serving as a reference voltage line through which a reference voltage is supplied or a sensing line and an N1 node (source or drain node) of the driving transistor DT. The second transistor T2 is controlled by a second scanning signal SCAN supplied through a second gate line GL2, and is connected between a data line DL and an N2 node (gate node) of the driving transistor DT. The capacitor Cst is connected between the N1 node and the N2 node of the driving transistor DT.

When the second transistor T2 is turned on, the second transistor T2 applies a data voltage Vdata supplied through the DIC 200 to the N2 node (gate node) of the driving transistor DT.

When the first transistor T1 is turned on, the first transistor T1 applies a reference voltage Vref supplied through the line SL to the N1 node (source or drain node) of the driving transistor DT. Here, the line SL serves as a reference voltage line.

In addition, the first transistor T1 is turned on according to the switching operation SW, and allows a voltage in the N1 node of the driving transistor DT to be applied to the line SL, such that the ADC 220 within the DIC 200 can sense the voltage in the N1 node of the driving transistor DT. Here, the line SL serves as a sensing line, and the N1 node of the driving transistor serves as a sensing node.

One line SL, as illustrated in FIG. 13, can be provided in each row of four subpixel rows (R, W, G and B).

According to the embodiments of the present invention as set forth above, it is possible to overcome the problem in that the luminance of each subpixel is not compensated or the difference in the levels of luminance between the subpixels is not compensated although the pixel compensation function is provided.

In addition, according to the embodiments of the present invention, although the result of sensing the sensing nodes within each subpixel is not accurate, the sensing result is compensated to have an accurate value. This can consequently prevent or reduce the non-uniformity of luminance, thereby improving the image quality of the display device 100.

Furthermore, according to the embodiments of the present invention, the ADC compensation technology capable of compensating for a change in the ADC characteristic is provided. When the characteristic of the ADC 220 corresponding to the sensing unit has changed, accurate pixel compensation can be performed using the ADC sensing result.

In addition, according to the embodiments of the present invention, the ADC compensation function efficiently compensates for a change in the ADC characteristic according to the DICs when the ADC characteristic has changed.

Furthermore, according to the embodiments of the present invention, the ADC compensation function accurately compensates for a change in the ADC characteristic according to the sensing channels when the ADC characteristic has changed.

Hereinabove, the necessity of the sensing unit compensation function as well as the configuration and operation thereof have been described in detail with reference to the drawings. Even in the case in which any initial deviation of the ADC is compensated, a change in the ADC characteristics caused by external factors cannot be compensated. Therefore, a difference in outputs from the DICs may lead to a source block dim. The source block dim may also occur when an offset or a gain intended to compensate for the initial deviation of the ADC is incorrectly extracted.

A detailed description will be given below of the "DIC output compensation function" to compensate for an output error of the data driver. Thereafter, a detailed description will be given of the "deviation compensation function for each DIC" to compensate for an output deviation by monitoring the output of each DIC when the data driver includes two or more DICs.

Figure 14:
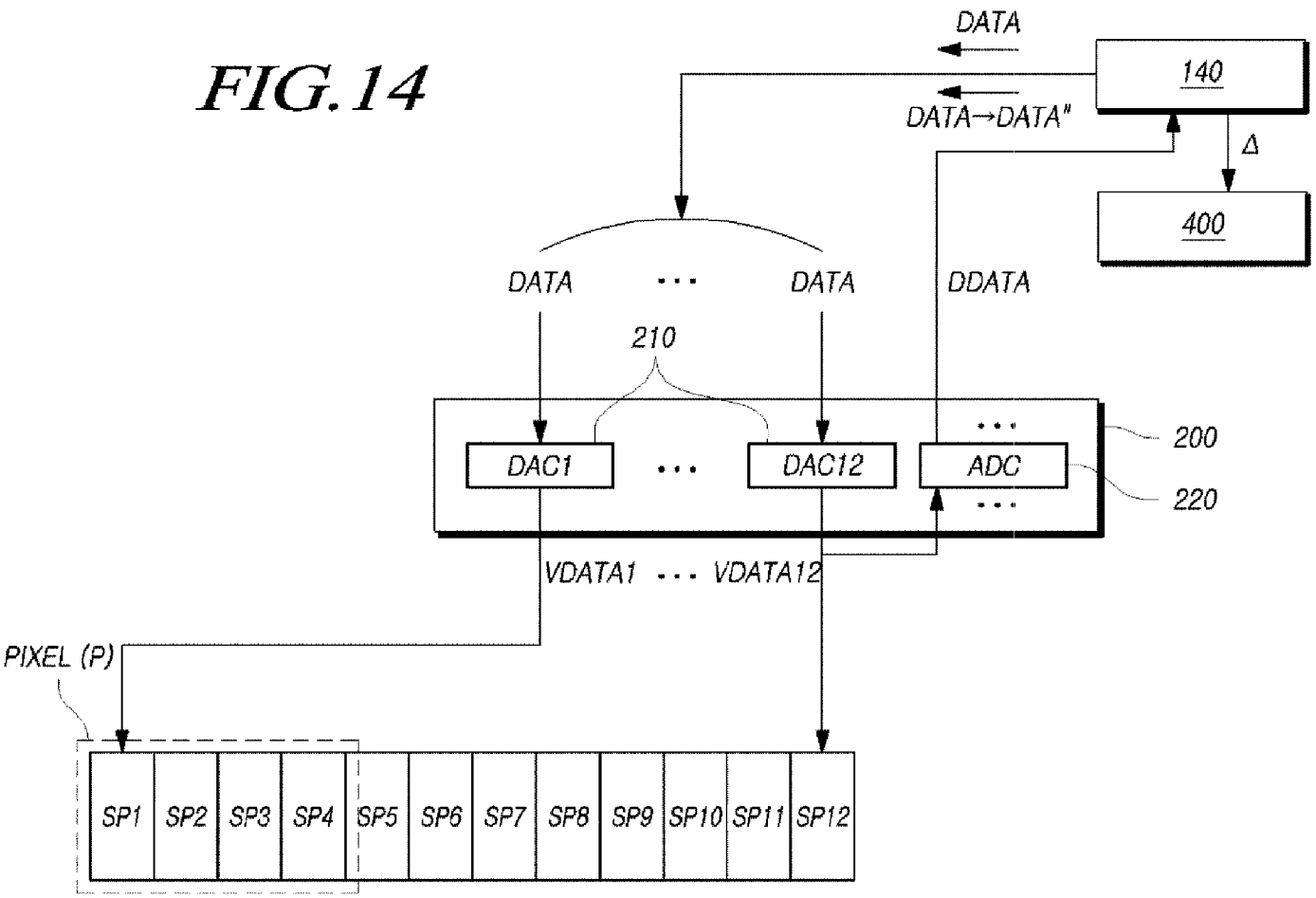
FIG. 14 is a diagram illustrating the DIC output compensation of the display device according to an exemplary embodiment of the present invention.

FIG. 14 illustrates the DIC output compensation of the display device 100 according to an exemplary embodiment.

As illustrated in FIG. 14, the DIC 200 includes DACs 210 corresponding to data lines and one ADC 220. The DIC 200 supplies an analog data voltage Vdata to twelve subpixels SP of three pixels P, each of the pixels include four subpixels, through twelve data lines. The number of the DACs 210 is the same as the number of the data lines, and the DACs 210 convert digital data to the analog data voltage Vdata.

When the characteristics of the DIC 200 are changed by external factors, the DIC may not complete the process of converting the data Data to the accurate data voltage Vdata and supply the data voltage Vdata to each of the subpixels through an output buffer.

As illustrated in FIG. 14, an output terminal (an output terminal of an output buffer when the output buffer is provided) of one DAC DAC12 of the DACs 210 (DAC1 to DAC12) is connected to an input terminal of the ADC 220. Since the output terminal of one DAC DAC12 of the DACs 210 (DAC1 to DAC12) is connected to the input terminal of the ADC 220, the ADC 220 can convert an analog data voltage Vdata12 to be supplied to one subpixel (e.g., SP12) to digital sensing data Ddata.

Data used when the DIC output compensation function is performed may be data having a monochrome pattern (e.g., a gray pattern). Since the output errors of the DICs are recognized by people at a low tone, the DIC output compensation function based on the low tone may be performed using the monochrome pattern of the low tone as data. For example, when digital data used for performing the DIC output compensation function is a value corresponding to 3 V, the sensing data supplied to the subpixel may be a value corresponding to 2.8 V.

When the characteristics of the DIC 200 are changed and the data corresponding to 3 V is supplied as a data voltage of 2.8 V to a specific subpixel SP9 in the foregoing example, the ADC 220 converts the data voltage of 2.8 V to the digital sensing data Ddata, and supplies the digital sensing data Ddata to the timing controller 140. The timing controller 140 stores a difference between original data and the sensing data (a value corresponding to 0.2 V) as an output error Δ of the DIC 200 in the memory 400.

When data are provided to the DIC 200 during actual driving, the timing controller 140 supplies compensation data Data", in which the output error of the DIC 200 is compensated, to the DIC 200 by reflecting the output error Δ (the value corresponding to 0.2 V in the foregoing example) stored in the memory 400.

The DIC 200 receives the compensation data Data" from the timing controller 140, and supplies an analog data voltage Vdata" to the subpixels SP1 to SP12. In the foregoing example, the DIC 200 supplies the compensation data Data" (=original data+Δ) to each subpixel.

The foregoing example has been described that the analog data voltage Vdata12 supplied to one subpixel SP12 is sensed and stored as an output error in the memory 400 and the compensated data Data" obtained by adding the output error Δ to the data is supplied to each subpixel during driving. However, it is possible to sense data voltages supplied to two or more subpixels, store an average of the sensed data voltages as an output error of the DIC 200 in the memory 400, and perform the output error compensation function of the DIC during driving.

Although the ADC 220 performing the pixel compensation function has been illustrated as the sensing unit that senses a data voltage in the foregoing example, the sensing unit that senses the data voltage may be separately provided in the display device 100.

Although the data driver 120 has been illustrated as having a single DIC 200 in the foregoing example, the data driver 120 may include two or more DICs, for example, three DICs 200*a*, 200*b*, and 200*c* as illustrated in FIG. 8.

Figure 15:
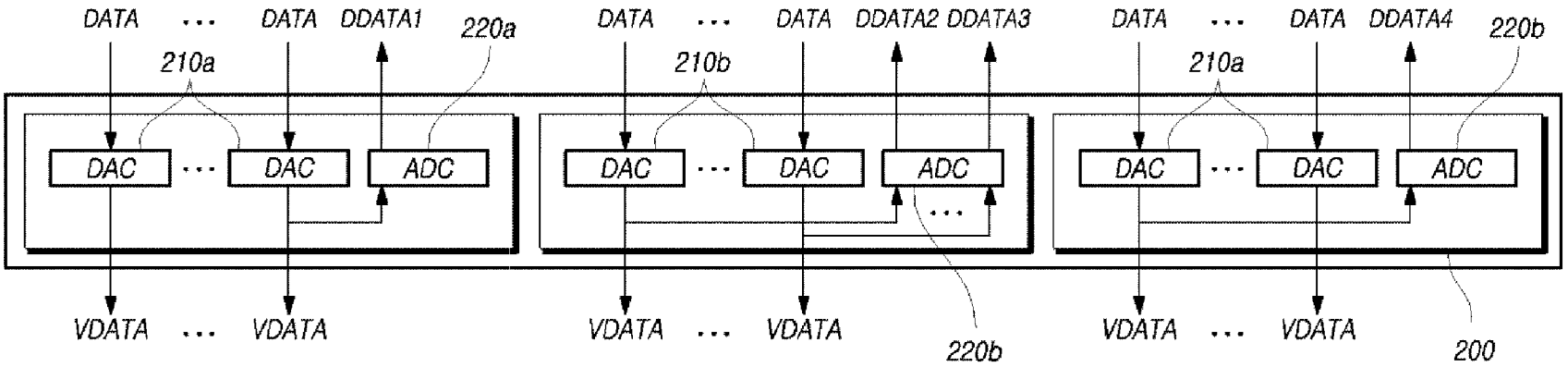
FIG. 15 is a detailed configuration diagram illustrating the data driver including three DICs as illustrated in FIG. 8.

FIG. 15 is a detailed configuration diagram illustrating the data driver 120 including the three DICs 200*a*, 200*b*, and 200*c* illustrated in FIG. 8.

Referring to FIG. 8 and FIG. 15, the data driver 120 is illustrated as including the three DICs 200*a*, 200*b*, and 200*c*.

For example, each of the three DICs 200*a*, 200*b*, and 200*c* includes two or more DACs 210 corresponding to data lines and at least one ADC 220.

The first DIC 200*a* includes the DACs 210*a* corresponding to the data lines and one ADC 220*a*. The second DIC 200*b* includes DACs 210*b* corresponding to the data lines and one ADC 220*b*. The third DIC 200*c* includes DACs 210*c* corresponding to the data lines and one ADC 220*c*. The configuration and operation of each of the three DICs 200*a*, 200*b*, and 200*c* may be identical to those of the DIC 200 illustrated above with reference to FIG. 14.

As described above, external factors may change the characteristics of each DIC and cause differences in the outputs of the DICs 200*a*, 200*b*, and 200*c*.

The output terminal of each of the DACs adjacent to a corresponding DIC of the two adjacent DICs is connected to the input terminal of the ADC in the corresponding DIC For example, the output terminal of the last DAC 210*a* of the first DIC 200*a* of the adjacent DICs is connected to the input terminal of the ADC 220*a*, and the output terminal of the first DAC 210*b* of the second DIC 200*b* of the adjacent DICs is connected to the input terminal of the ADC 220*b*. The ADC 220*a* of the first DIC 200*a* can convert an analog data voltage Vdata supplied to one subpixel to digital sensed data Ddata1. The ADC 220*b* of the second DIC 200*b* can convert an analog data voltage Vdata supplied to one subpixel to digital sensed data Ddata2 and the other analog data voltage Vdata supplied to another subpixel to digital sensed data Ddata3.

The output terminal of the last DAC 210*b* of the second DIC 200*b* of the adjacent DICs is connected to the input terminal of the ADC 220*b*, and the output terminal of the first DAC 210*c* of the third DIC 200*c* is connected to the input terminal of the ADC 220*c*. The third DIC 200*c* can convert the analog data voltage Vdata supplied to one subpixel to digital sensed data Ddata4.

Specifically, the data driver 120 includes two or more DACs electrically connected to data lines to supply a data voltage to the data lines and an ADC transmitting sensed data obtained by sensing the data voltage supplied to one data line connected to one DAC. Here, two or more DICs each including two or more DACs and one ADC are provided, and the output terminal of one DAC of the DACs of each DIC can be connected to the input terminal of the ADC. In addition, the DAC of each DIC, with the output terminal being connected to the input terminal of the ADC, can be adjacent to another DIC. When other DICs are adjacent to both ends of one DIC, the output terminals of the two DACs adjacent to the other DICs can be connected to the input terminal of the ADC.

Data used in performing the compensating function for the differences between the DICs may have a monochrome pattern (e.g., a gray pattern). Since the differences in the outputs between the DICs at a low tone are recognized by people, it is possible to perform the compensating function for the differences in the outputs between the DICs based on the low tone using the low-tone monochrome pattern as data.

Figure 16:
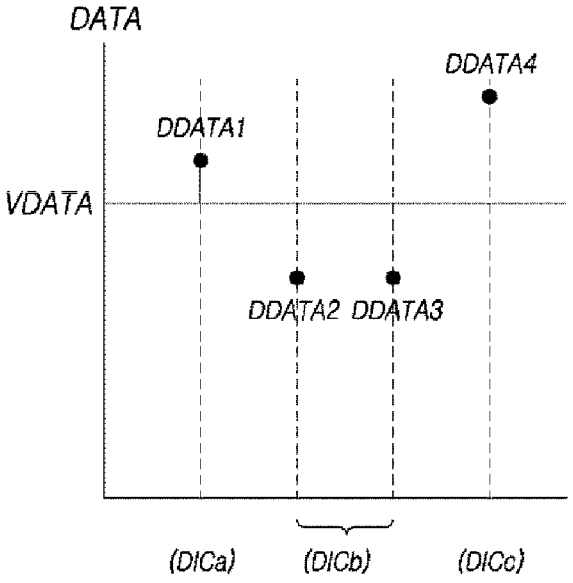
FIG. 16 illustrates the differences between the DICs in the display device according to an exemplary embodiment of the present invention.

FIG. 16 illustrates the differences between the DICs in the display device 100 according to an exemplary embodiment.

AS illustrated in FIG. 16, when each of the individual DICs 200*a*, 200*b*, and 200*c* applies an input data corresponding to 3 V (Data=3 V) to the corresponding subpixel, the ADCs 220*a*, 220*b*, 220*c*, and 220*d* can sense data, i.e., Ddata1=3.2 V, Ddata2=2.8 V, Ddata3=2.8 V, and Ddata=3.4 V, due to differences between the DICs 200*a*, 200*b*, and 200*c* caused by external factors.

As illustrated in FIG. 16, the individual ADCs 220*a*, 220*b* and 220*c* supply the sensed data, i.e., Ddata1=3.2 V, Ddata2=2.8 V, Ddata3=2.8 V, and Ddata4=3.6 V, to the timing controller 140. For example, as described above with reference to FIG. 14, the difference between the original data and the sensed data can be stored as an output error Δ of each of the DICs 200*a*, 200*b*, and 200*c* in the memory 400. In this case, it is possible to simultaneously compensate for the output error of the DICs, but also the differences in the outputs among the DICs.

TABLE 1

| | First DIC | Second DIC | Third DIC |
|---|---|---|---|
| Output error Δ | Value corresponding to +0.2 V | Value corresponding to −0.2 V | Value corresponding to +0.6 V |

For another example, the timing controller 140 can store the differences between the sensed data and the average of the sensed data as the output errors Δ of the DICs 200*a*, 200*b*, and 200*c* in the memory 400 regardless of the original input data. In other words, since the average of the sensed data is 3.2 V in the foregoing example, the timing controller 140 can store the differences between the sensed data and the average of the sensed data as the output errors Δ of the DICs 200*a*, 200*b*, and 200*c* in the memory 400, as presented in Table 2 below. Since the output errors Δ of the individual DICs 200*a*, 200*b*, and 200*c* are calculated using only the sensed data and are stored in the memory 400, it is not required to separately store the input data used in sensing in the memory 400. It is therefore possible to minimize the use of the memory and reduce the period of time required for compensating the differences between the DICs.

TABLE 2

| | First DIC | Second DIC | Third DIC |
|---|---|---|---|
| Output error Δ | Value corresponding to 0 V | Value corresponding to −0.4 V | Value corresponding to +0.4 V |

Although the foregoing example has been described that each of the DICs 200*a*, 200*b*, and 200*c* apply the same input data to the corresponding sub-pixels and the ADCs 220*a*, 220*b* and 220*c* respectively sense the data, the DICs 200*a*, 200*b*, and 200*c* may apply different input data or the DACs of each of the DICs 200*a*, 200*b*, and 200*c* may apply different data. For example, during actual driving, the ADCs 220*a*, 220*b*, and 220*c* sense data in a specific frame, and actual input data are compared with the sensed data, whereby the output errors of the DICs are calculated.

When the timing controller 140 supplies input data to the DICs 200*a*, 200*b*, and 200*c* during actual driving, the timing controller 140 supplies compensation data Data" to the DICs 200*a*, 200*b*, and 200*c* by compensating for the output errors of the DICs 200*a*, 200*b*, and 200*c* by reflecting the output error Δ (a value corresponding to 0.2 V in the foregoing example) stored in the memory 400 as presented in Table 1 or Table 2.

Each of the DICs 200*a*, 200*b*, and 200*c* receives the compensation data Data" from the timing controller 140, and supplies an analog data voltage (Vdata"=original input data+Δ) to the subpixels.

Figure 17:
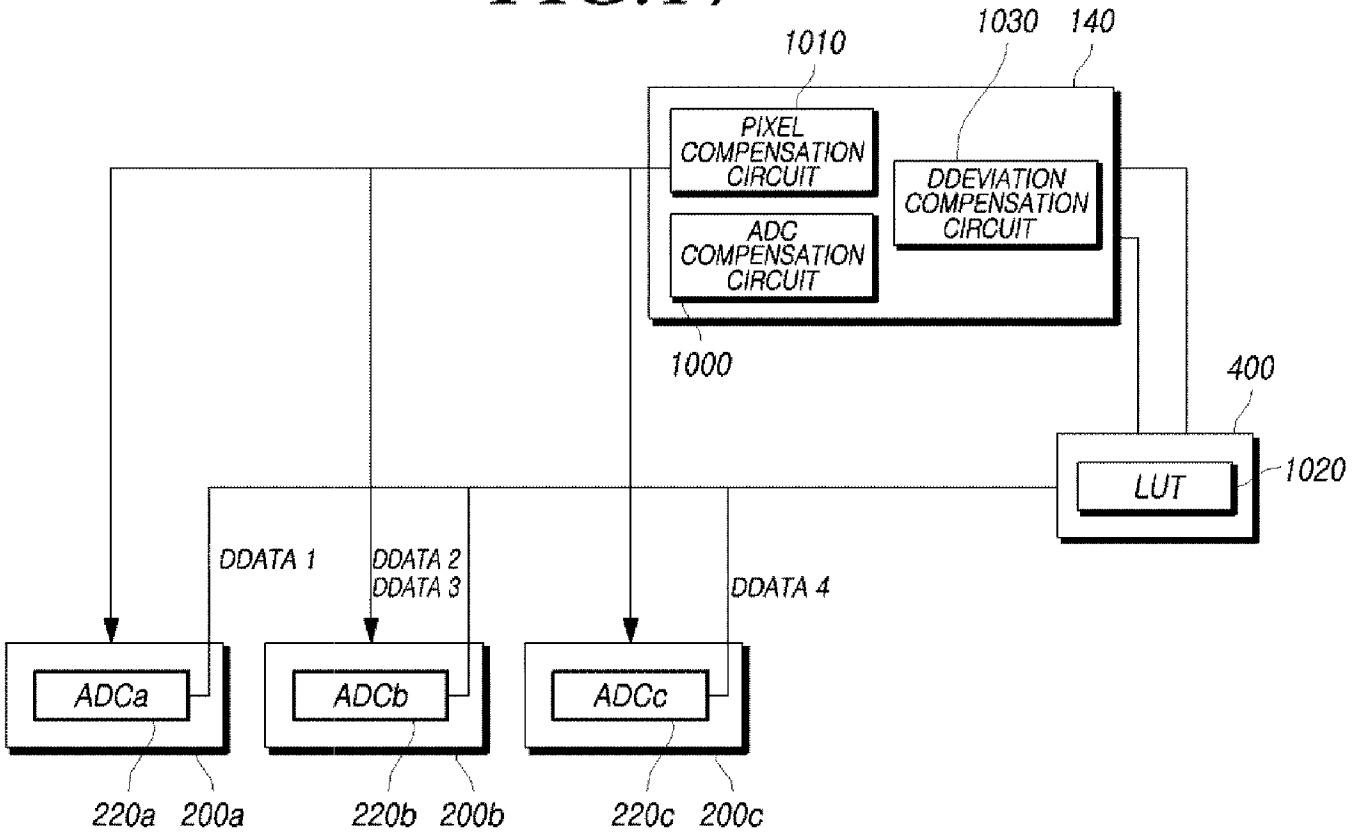
FIG. 17 is a schematic configuration diagram illustrating compensation for the differences between the DICs in the display device according to an exemplary embodiment of the invention after the changes in the ADC characteristics are compensated.
Figure 18:
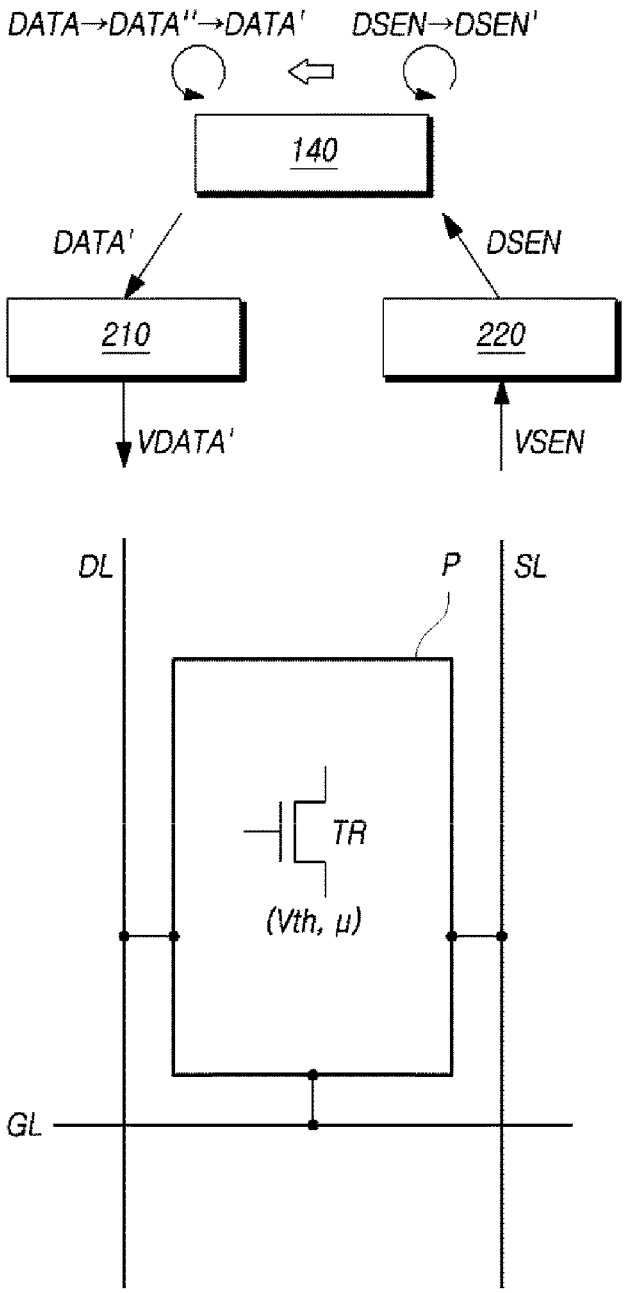
FIG. 18 is a conceptual view illustrating pixel compensation in the display device according to an exemplary embodiment of the invention to which compensation for the differences between the DICs is applied after the ADC compensation.

FIG. 17 is a schematic configuration diagram illustrating compensation for the differences between the DICs in the display device 100 according to an exemplary embodiment of the invention after the changes in the ADC characteristics are compensated. FIG. 18 is a conceptual view illustrating pixel compensation in the display device 100 according to an exemplary embodiment of the invention to which compensation for the differences between the DICs is applied after the ADC compensation.

Referring to FIG. 17, the display device 100 according to an exemplary embodiment includes a deviation compensation circuit 1030 in addition to the ADC compensation circuit 1000 and the pixel compensation circuit 1010 illustrated in FIG. 10. The deviation compensation circuit 1030 is included together with the ADC compensation circuit 1000 and the pixel compensation circuit 1010 in the timing controller 140.

The lookup table 1020 stored in the memory 400 includes a first lookup table for threshold voltage sensing mode, a second lookup table for mobility sensing mode, and a third lookup table including ADC characteristics information according to sensing channels, the first to third lookup tables being separate from each other. The lookup table 1020 further includes a fourth lookup table including the output errors of the DICs.

The ADC compensation operation performed by the ADC compensation circuit 1000 and the pixel compensation operation performed by the pixel compensation circuit 1010 may be identical to those described above with reference to FIG. 10 and FIG. 11.

The deviation compensation circuit 1030 compensates for the output deviation between the DICs independently of or in cooperation with the ADC compensation of the ADC compensation circuit 1000 and the pixel compensation of the pixel compensation circuit 1010.

The ADC compensation circuit 1000 updates the lookup table 1020 including the ADC characteristics information according to the sensing channels, as described above with reference to FIG. 10 and FIG. 11.

The pixel compensation circuit 1010 of the timing controller 140 performs pixel compensation to compensate for the characteristics (e.g., a threshold voltage Vth or mobility μ) of the transistor in each subpixel based on the changed sensed data Dsen' of the sensed data Dsen according to the lookup table updated by the ADC compensation circuit 1000.

The deviation compensation circuit 1030 stores the output errors of the DICs in the lookup table 1020, as described above with reference to FIG. 15.

Consequently, the timing controller 140 changes the data Data to be supplied to the subpixels SP to the changed data Data' based on the changed sensed data Dsen' according to the lookup table 1020 updated by the ADC compensation circuit 1000, and outputs the compensation data Data" obtained by compensating for the changed data Data' based on the output error of each of the DICs according to the lookup table 1020 stored by the deviation compensation circuit 1030. Accordingly, each of the DACs 210*a*, 210*b*, and 210*c* in the DICs 200*a*, 200*b*, and 200*c* converts the compensation data Data" to the data voltage Vdata", and supplies the data voltage Vdata" to the corresponding subpixels SP.

The DIC output error compensation and the compensation for the output deviation between the DICs may be performed when a power off signal has occurred, or may be performed in real time while the power is on.

The DIC output error compensation or the compensation for the output deviation between the DICs may be performed while initial pixel compensation and/or ADC compensation are being performed. In addition, the DIC output error compensation or the compensation for the output deviation between the DICs may be formed while the display device being powered on. Furthermore, the DIC output error compensation or the compensation for the output deviation between the DICs may be performed while a gray pattern is being output during normal driving.

The DIC output error compensation or the compensation for the output deviation between the DICs may be performed after the ADC compensation.

When the DIC output error compensation or the compensation for the output deviation between the DICs is performed in real time after the ADC compensation (i.e., RTDS) while the power is on, the timing for the RT compensation corresponding to the pixel compensation, the RTDS corresponding to the ADC compensation, the DIC output error compensation, and the compensation for output deviation between the DICs that are performed in real time while the display device 100 is being powered on must be controlled. Therefore, the timing controller 140 can control the timing such that all of the pixel compensation (RT), the ADC compensation (RTDS), the DIC output error compensation, and the compensation for the output deviation between the DICs must be performed before the power off signal of the display device 100 is generated, i.e., when the display device 100 is being turned on.

The DIC output error compensation or the compensation for the output deviation between the DICs may be performed before normal driving after the ADC compensation while the display device 100 is being powered on.

In addition, according to the embodiments of the invention, the output error of the data driver can be compensated. When the data driver includes two or more DICs, it is possible to compensate for the output deviation by monitoring the outputs of the DICs.

Furthermore, according to the embodiments of the invention, since the output error of the data driver and the output deviation of the DICs are compensated, luminous non-uniformity is prevented or reduced, thereby allowing the display device to have superior image quality.

Although the display device 100 according to an exemplary embodiment of the present invention has been described as being an OLED display device, the display device 100 may be implemented as any display device, such as a liquid crystal display (LCD) or a plasma display panel (PDP).

The foregoing descriptions and the accompanying drawings have been presented in order to explain the certain principles of the present invention. A person skilled in the art to which the invention relates can make many modifications and variations by combining, dividing, substituting for, or changing the elements without departing from the principle of the invention. The foregoing embodiments disclosed herein shall be interpreted as illustrative only but not as limitative of the principle and scope of the invention. It should be understood that the scope of the invention shall be defined by the appended claims and all of their equivalents fall within the scope of the invention.

What is claimed is:

1. A display device comprising:

a display panel on which subpixels are disposed;

a data driver including at least two data driving integrated circuits (ICs) adapted to supply a data voltage corresponding to a test pattern data to at least one data line connected to the at least two data driving ICs;

at least one analog-to-digital converter sensing at least one data voltage supplied to at least one data line, and converting the sensed data voltages to digital sensed data; and a controller adapted to supply compensation data generated based on the digital sensed data to the data driver connected to at least one data line of the data lines, wherein the controller includes a deviation compensation circuit compensating for a deviation of the data driver based on the digital sensed data, wherein the display panel comprises at least one of sensing line for one or more subpixels, the sensing line being connected to the one or more subpixels, the one or more analog-to-digital converters concerting sensed voltages measured through one or more sensing channels corresponding to the sensing lines to the digital sensed data, and wherein the controller is adapted to acquire average sensed data according to the data driver ICs by averaging a plurality of sensed data obtained from the one or more analog-to-digital converters, each of which is include in a corresponding data driver IC of the two or more data driver ICs, to perform an analog-to-digital converter compensation by updating a lookup table based on a difference between the average sensed data according to the data driver ICs for a same voltage and reference data according to the data driver ICs.

2. The display device as claimed in claim 1, wherein the least one analog-to-digital converter is adapted to sense at least one data voltage of each of the at least two data driving ICs, and convert the sensed data voltages to digital sensed data.

3. The display device as claimed in claim 2, wherein the same test pattern data is supplied to data lines connected to the at least two data driving ICs.

4. The display device according to the claim 3, wherein at least one output terminal of each of the at least two data driver ICs is connected to the analog-to-digital converter of the data driver ICs.

5. The display device as claimed in claim 2, wherein the analog-to-digital converter is included in one of the at least two data driving ICs or in the controller or each data driver IC includes one analog-to-digital converter.

6. The display device as claimed in claim 1, wherein the test pattern data is supplied to one data line of first data driving ICs and to one data line of second data driving ICs, wherein the two data lines are adjacent to each other and the first and second data driving ICs are adjacent to each other, and wherein the least one analog-to-digital converter is adapted to sense the data voltages supplied to the adjacent data lines of the two adjacent data driving ICs.

7. The display device as claimed in claim 1, wherein each data driving IC includes a plurality of digital-analog converters, corresponding to the number of data lines connected to a respective data driving IC.

8. The display device according to claim 7, wherein the analog-to-digital converter is adapted to sense the data voltage supplied to at least one data line of the data lines connected to one digital-to-analog converter of the two or more digital-to-analog converters and/or is adapted to convert the sensed voltages into sensed data.

9. The display device according to the claim 1, wherein at least one outermost output of each of the data driver ICs is connected to the one analog-to-digital converter or the two outermost outputs of data driver ICs are connected to the analog-to-digital converter included in the data driver IC, respectively.

10. The display device as claimed in the claim 1, further comprising a memory, wherein the controller is adapted to store a difference value indicating at least one of the sensed data, and a difference between a reference value based on the test pattern data and the sensed data in the memory, and wherein the compensation data is calculated based on the difference value.

11. The display device according to claim 10, wherein the controller is adapted to store output errors according to the data driver ICs in the memory, the output errors being differences between the reference data based on the test pattern data and the sensed data, and to supply compensation data produced by compensating for the sensed data with the output errors stored according to the data driver ICs to each of the data driver ICs.

12. The display device according to claim 10, wherein the controller is adapted to store output errors for the data driver ICs in the memory, the output errors being differences between the sensed data of the data driver ICs and an average of the sensed data, and to supply compensation data produced by compensating for the sensed data with the output errors stored according to the data driver ICs to the data driver integrated circuits.

13. The display device according to claim 1, wherein the controller is adapted to subsequently compensate for a threshold voltage of a transistor within each of the subpixels by referring to the updated lookup table after the analog-to-digital converter compensation.

14. The display device according to claim 1, wherein the controller is adapted to compensate for a deviation in the data driver after the analog-to-digital converter compensation and/or during normal driving.

15. The display device according to claim 1, wherein the test data pattern corresponds to a monochrome pattern.

16. A method for driving a display device including a display panel having a plurality of subpixels, at least one of sensing line being connected to the one or more subpixels and a data driver including at least two data driving integrated circuits (ICs) and an analog-to-digital converter and a controller, the method comprising:

supplying a data voltage corresponding to test pattern data to data lines connected to the at least two data driving ICs;

sensing a data voltage supplied to at least one data line of the data lines through one or more sensing channels corresponding to the sensing lines;

converting the sensed data voltage to digital sensed data; and supplying compensation data compensated based on the digital sensed data to at least one data line of the data lines, wherein, the supplying the compensation data includes:

acquiring average sensed data according to the data driver ICs by averaging a plurality of sensed data obtained from the one or more analog-to-digital converters, each of which is included in a corresponding data driver IC of the two or more data driver ICs; and performing an analog-to-digital converter compensation by updating a lookup table based on a difference between the average sensed data according to the data driver ICs for a same voltage and reference data according to the data driver ICs.

* * * * *